US011077581B2

(12) United States Patent
Yoda et al.

(10) Patent No.: US 11,077,581 B2
(45) Date of Patent: Aug. 3, 2021

(54) SHEET MANUFACTURING APPARATUS AND CONTROL METHOD OF SHEET MANUFACTURING APPARATUS

(71) Applicant: SEIKO EPSON CORPORATION, Tokyo (JP)

(72) Inventors: Kaneo Yoda, Nagano (JP); Yoshiyuki Nagai, Nagano (JP); Yuki Oguchi, Nagano (JP); Shigeo Fujita, Nagano (JP); Akira Arai, Shimosuwa-machi (JP); Kazuhiro Ichikawa, Nagano (JP); Teruaki Oguchi, Nagano (JP); Seiichi Taniguchi, Asahi-mura (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/497,473

(22) PCT Filed: Feb. 22, 2018

(86) PCT No.: PCT/JP2018/006523
§ 371 (c)(1),
(2) Date: Sep. 25, 2019

(87) PCT Pub. No.: WO2018/180066
PCT Pub. Date: Oct. 4, 2018

(65) Prior Publication Data

US 2020/0101637 A1 Apr. 2, 2020

(30) Foreign Application Priority Data

Mar. 27, 2017 (JP) ..... JP2017-060605

(51) Int. Cl.
*B27N 3/04* (2006.01)
*D04H 1/732* (2012.01)
(Continued)

(52) U.S. Cl.
CPC ..... *B27N 3/04* (2013.01); *D04H 1/732* (2013.01); *B27N 1/02* (2013.01); *D04H 1/60* (2013.01);
(Continued)

(58) Field of Classification Search
CPC ..... D21F 1/74; D21F 2/00; D21F 7/06; D21F 1/48; D21G 9/0027; D21G 9/0009;
(Continued)

(56) References Cited

U.S. PATENT DOCUMENTS 2,771,246 A * 11/1956 Schneider ..... D21G 9/0045 236/1 R
9,498,896 B2 11/2016 Oguchi
(Continued)

FOREIGN PATENT DOCUMENTS

CN 106062267 A 10/2016
JP 2012-167414 A 9/2012
(Continued)

*Primary Examiner* — Eric Hug
*Assistant Examiner* — Elisa H Vera
(74) *Attorney, Agent, or Firm* — Global IP Counselors, LLP

(57) ABSTRACT

A sheet manufacturing apparatus is an apparatus that heats a material containing fibers to form a sheet, and includes a heating portion that heats the material, and a control portion that controls a temperature at which the heating portion heats the material. The control portion sets a temperature of the heating portion to a first temperature in a first state where the sheet manufacturing apparatus manufactures the sheet, and sets the temperature of the heating portion to a second temperature lower than the first temperature at a predetermined timing in a second state where the sheet is not manufactured, or at a predetermined timing when a state of the sheet manufacturing apparatus is shifted to the state where the sheet is not manufactured.

16 Claims, 20 Drawing Sheets

(51) Int. Cl.

| | |
|---|---|
| ***B27N 1/02*** | (2006.01) |
| ***D04H 1/60*** | (2006.01) |
| ***D21B 1/08*** | (2006.01) |
| ***D21F 9/00*** | (2006.01) |
| ***D21G 9/00*** | (2006.01) |

(52) U.S. Cl.
CPC ..... *D21B 1/08* (2013.01); *D21F 9/00* (2013.01); *D21G 9/0009* (2013.01)

(58) Field of Classification Search
CPC ..... D21G 9/0036; D21G 9/0045; B27N 3/14; B27N 3/18; B27N 3/146; B27N 1/029; B27N 3/04; D04H 1/60; D04H 1/736; D04H 1/732; D21B 1/06; D21B 1/08; B21B 1/08
See application file for complete search history.

(56) References Cited

U.S. PATENT DOCUMENTS

2002/0129909 A1* 9/2002 de Jong ..... D21D 5/00 162/4
2007/0062663 A1* 3/2007 Tamai ..... D21B 1/32 162/232
2007/0255445 A1* 11/2007 Tran ..... D21G 1/0053 700/127
2007/0255446 A1* 11/2007 Backstrom ..... D21G 9/0009 700/128
2014/0290886 A1* 10/2014 Nagai ..... D21H 25/04 162/252
2015/0240418 A1 8/2015 Oguchi
2016/0230320 A1 8/2016 Ueno et al.
2016/0332325 A1 11/2016 Murayama et al.
2018/0237992 A1 8/2018 Nagai et al.

FOREIGN PATENT DOCUMENTS

JP 2013-087368 A 5/2013
JP 2015-092032 A 5/2015
JP 2015-155180 A 8/2015
JP 2015-161035 A 9/2015
JP 2016-130009 A 7/2016

* cited by examiner

FIG. 10

| DRIVE PORTION | FIRST STATE (OPERATION STATE) | SECOND STATE (STANDBY STATE) | STOPPED STATE (OFF) |
|---|---|---|---|
| SUPPLY PORTION | ON | OFF | OFF |
| COARSE CRUSHING PORTION | ON | OFF | OFF |
| DEFIBRATING PORTION | ON | OFF | OFF |
| SORTING PORTION | ON | OFF | OFF |
| FIRST WEB FORMING PORTION | ON | OFF | OFF |
| ROTATING BODY | ON | OFF | OFF |
| MIXING PORTION | ON | OFF | OFF |
| ACCUMULATING PORTION | ON | OFF | OFF |
| SECOND WEB FORMING PORTION | ON | OFF | OFF |
| PRESSURIZING PORTION | ON | OFF | OFF |
| HEATING PORTION (TRANSPORT) | ON | OFF | OFF |
| HEATING PORTION (HEATER) | ON | ON | OFF |
| CUTTING PORTION | ON | OFF | OFF |
| DISCHARGE PORTION | ON | OFF | OFF |
| HUMIDIFYING HEATER | ON | ON | OFF |

FIG. 11

| CARTRIDGE | TEMPERATURE DATA |
|---|---|
| YELLOW | Th11 |
| MAGENTA | Th12 |
| CYAN | Th13 |
| WHITE | Th14 |
| PLAIN | Th15 |

SHEET MANUFACTURING APPARATUS AND CONTROL METHOD OF SHEET MANUFACTURING APPARATUS

CROSS-REFERENCE TO RELATED APPLICATIONS

This application is a U.S. National stage application of International Patent Application No. PCT/JP2018/006523, filed on Feb. 22, 2018, which claims priority under 35 U.S.C. § 119(a) to Japanese Patent Application No. 2017-060605, filed in Japan on Mar. 27, 2017. The entire disclosure of Japanese Patent Application No. 2017-060605 is hereby incorporated herein in its entirety by reference.

TECHNICAL FIELD

The present invention relates to a sheet manufacturing apparatus and a control method of the sheet manufacturing apparatus.

BACKGROUND ART

In general, in a sheet manufacturing apparatus, an apparatus having a heating portion for heating a material have been known (for example, refer to Japanese Unexamined Patent Application Publication No. 2016-130009). The sheet manufacturing apparatus described in Japanese Unexamined Patent Application Publication No. 2016-130009 forms a sheet by heating a material containing fibers and a resin.

Incidentally, in activating a sheet manufacturing apparatus from a stopped state, time for heating up a heating portion to an appropriate temperature has been required. In order to reduce this time, it is conceivable to maintain the heating portion at the appropriate temperature even when a sheet is not manufactured. However, since such control consumes a large amount of energy even though a sheet is not manufactured, energy efficiency may be reduced.

In a sheet manufacturing apparatus manufacturing a sheet, an object of the present invention is to reduce a time it takes the apparatus to be able to start manufacture of a sheet from a stopped state by a method in which a decrease in energy efficiency is unlikely to occur.

SUMMARY

In order to solve the above problems, according to an aspect of the present invention, there is provided a sheet manufacturing apparatus heating a material containing fibers to form a sheet, the apparatus including a heating portion that heats the material, and a control portion that controls a temperature at which the heating portion heats the material, in which the control portion sets a temperature of the heating portion to a first temperature in a state where the sheet manufacturing apparatus manufactures the sheet, and sets the temperature of the heating portion to a second temperature lower than the first temperature at a predetermined timing in a state where the sheet is not manufactured, or at a predetermined timing when a state of the sheet manufacturing apparatus is shifted to the state where the sheet is not manufactured.

According to the present invention, the temperature of the heating portion can be controlled to the second temperature lower than the first temperature in the state of manufacturing the sheet. Therefore, for example, when the heating portion is set to the second temperature in the standby state where the sheet is not manufactured and the heating portion is raised to the first temperature when the manufacture of the sheet is started, the manufacture of the sheet can be started more rapidly than when the heating portion is completely stopped. As a result, in the sheet manufacturing apparatus manufacturing the sheet, it is possible to reduce the time it takes the apparatus to be able to start the manufacture of the sheet from the stopped state by the method in which the decrease in energy efficiency is unlikely to occur.

In addition, in the above-described configuration, the apparatus may further include a reception portion that receives an input from an outside, in which the control portion may be configured to change the temperature of the heating portion from the first temperature to the second temperature, or from the second temperature to the first temperature in response to the input received by the reception portion.

According to the present invention, control can be performed to change the temperature of the heating portion in response to the input from the outside.

In addition, in the above-described configuration, the reception portion may be configured to receive an input of a type of the sheet to be manufactured, and the control portion may be configured to change the temperature of the heating portion from the first temperature to the second temperature, or from the second temperature to the first temperature according to a change in the type of the sheet to be manufactured, by the input in the reception portion.

According to this configuration, when the type of sheet is input, control can be performed to change the temperature of the heating portion in response to the input. Therefore, for example, when the temperature condition of the heating portion at the time of manufacturing the sheet is different depending on the type of the sheet, the temperature of the heating portion can be rapidly changed to a temperature suitable for the type of sheet.

In addition, in the above-described configuration, the apparatus may further include a supply portion that supplies a plurality of types of raw materials, each containing fibers, and a defibrating portion that defibrates the raw material supplied by the supply portion, in which the control portion may be configured to change the temperature of the heating portion from the first temperature to the second temperature, or from the second temperature to the first temperature according to a change in a type of the raw material supplied by the supply portion.

According to this configuration, heating is performed by the heating portion at a temperature suitable for the raw material for manufacturing the sheet, and a high quality sheet can be manufacture.

In addition, in the above-described configuration, the apparatus may further include a plurality of accommodation portions that accommodate the plurality of types of the raw materials for the respective types, in which the supply portion may be configured to select and supply any one of the plurality of types of the raw materials accommodated in the accommodation portion.

According to this configuration, it is possible to easily supply different types of the raw materials, and in the step of manufacturing the sheet from the raw materials, a high quality sheet can be manufactured by heating at a temperature suitable for the raw materials.

In addition, in the above-described configuration, the apparatus may further include a cartridge that contains a binding material, in which the control portion may be configured to acquire temperature information from the cartridge, and to determine the first temperature based on the acquired temperature information.

According to this configuration, the first temperature of the heating portion can be set to the temperature based on the temperature information acquired from the cartridge. Therefore, by acquiring the temperature information related to the temperature of the heating portion suitable for the binding material from the cartridge, the sheet manufacturing apparatus can manufacture the sheet at the temperature suitable for the binding material without preparing special information in advance.

In addition, in the above-described configuration, the apparatus may further include a cartridge that contains a binding material, in which the control portion may be configured to acquire temperature information from the cartridge, and to determine the second temperature based on the acquired temperature information.

According to this configuration, the second temperature of the heating portion can be set to the temperature based on the temperature information acquired from the cartridge. Therefore, by appropriately setting the second temperature based on the temperature information related to the temperature of the heating portion suitable for the binding material from the cartridge, when the temperature of the heating portion is raised to the first temperature, the temperature can be rapidly raised, and the standby time can be reduced.

In addition, in the above-described configuration, the apparatus may further include a transport portion that transports the material to the heating portion, in which at least an operation of transporting the material to the heating portion by the transport portion may be configured to be performed in the state where the sheet is manufactured, and at least the transport portion may be configured to be stopped in the state where the sheet is not manufactured.

According to this configuration, the heating portion is controlled to the first temperature while the material is transported, and the temperature of the heating portion is set to the second temperature in the state where the transport of the material is stopped. As a result, the decrease in energy efficiency while the material is not transported can be suppressed, and the temperature of the heating portion can be rapidly raised when the next transport of the material is started, and the standby time can be reduced.

In addition, in the above-described configuration, the apparatus may further include a humidifying portion that has a heat source and humidifies the material, in which the heat source of the humidifying portion may be configured to be operated in the state where the sheet is not manufactured.

According to this configuration, since the heat source of the humidifying portion is not stopped in the state where the sheet is not manufactured, appropriate humidification can be rapidly started when the manufacture of the sheet is restarted thereafter. Therefore, the manufacture of the sheet can be rapidly started. In addition, when the manufacture of the sheet is restarted, the appropriate humidification state of the material is rapidly realized, so that a high quality sheet can be manufactured.

In addition, in the above-described configuration, the control portion may be configured to change the temperature of the heating portion from the first temperature to the second temperature based on a time during which the state where the sheet is not manufactured continues.

According to this configuration, the temperature of the heating portion can be reduced corresponding to the operation state of the sheet manufacturing apparatus, the state where the manufacture of the sheet can be rapidly started can be maintained, and the decrease in energy efficiency can be suppressed.

In addition, in the above-described configuration, the control portion may be configured to stop a control of the temperature of the heating portion based on a time during which the state where the sheet is not manufactured continues.

According to this configuration, the energy efficiency can be further improved by stopping the heating of the heating portion corresponding to the operation state of the sheet manufacturing apparatus.

In addition, in the above-described configuration, the control portion may be configured to change the temperature of the heating portion from the second temperature to a third temperature lower than the second temperature based on a time during which the state where the sheet is not manufactured continues.

According to this configuration, the heating temperature of the heating portion can be reduced corresponding to the operation state of the sheet manufacturing apparatus, the state where the manufacture of the sheet can be rapidly started can be maintained, and the energy efficiency can be further improved.

In addition, in the above-described configuration, the sheet may be configured to be manufactured based on a job including at least an instruction to start and end manufacture of the sheet, or designation of a manufacturing volume, and the control portion may be configured to shift the state of the sheet manufacturing apparatus to a suspended state where the sheet is not manufactured during an operation of manufacturing the sheet based on the job, and to set the temperature of the heating portion to the second temperature lower than the first temperature in the suspended state.

According to this configuration, while manufacturing the sheet based on the job, the temperature of the heating portion can be changed to a lower second temperature to be in the suspended state. As a result, for example, it is possible to perform a treatment that is difficult during the operation of manufacturing the sheet, such as changing the material and changing the type of the sheet, while the job is performed. In addition, since the temperature of the heating portion is controlled to the second temperature in the suspended state, the decrease in energy efficiency can be suppressed. Furthermore, when the manufacture of the sheet is resumed from the suspended state, the heating portion is controlled to the second temperature, so that the manufacture of the sheet can be rapidly started.

In addition, in the above-described configuration, the sheet may be configured to be manufactured based on a job including at least an instruction to start and end manufacture of the sheet, or designation of a manufacturing volume, and the control portion may be configured to shift the state of the sheet manufacturing apparatus to a standby state where the sheet is not manufactured after an operation of manufacturing the sheet based on the job is completed, and to change the temperature of the heating portion from the first temperature to the second temperature based on a time during which the standby state continues.

According to this configuration, since the temperature of the heating portion is controlled to the second temperature after the manufacture of the sheet based on the job is completed, the manufacture of the sheet can be rapidly started when the manufacture of the sheet is performed again. In addition, the decrease in energy efficiency can be suppressed by setting the temperature of the heating portion to second temperature.

In addition, in the above-described configuration, the control portion may be configured to change the temperature of the heating portion from the second temperature to the first temperature in response to the input from an outside.

According to this configuration, the temperature of the heating portion can be raised from the second temperature to the first temperature in response to the input from the outside. As a result, for example, separately from the control for starting the manufacture of the sheet, the heating portion can be heated to prepare for the start of the manufacture of the sheet, and a state where the manufacture of the sheet can be rapidly started can be realized at any timing.

In addition, in the above-described configuration, the heating portion may be configured to include a heating roller pair that interposes and heats the material, the heating roller pair may be configured to be displaced between a first position interposing the material and a second position not interposing the material, and the control portion may be configured to displace the heating roller pair to the second position, when the control portion changes the temperature of the heating portion from the first temperature to the second temperature.

According to this configuration, when the temperature of the heating portion is set to the second temperature, the heating roller pair is displaced, so that the heating portion can be in a state suitable to stand by at a temperature lower than the first temperature. As a result, the influence on the material located in the heating portion can be suppressed in the state where the heating portion has the second temperature, and the loss of material can be reduced.

In addition, in order to solve the above problems, according to another aspect of the present invention, there is provided a control method of a sheet manufacturing apparatus heating a material containing fibers to form a sheet, the method including controlling a temperature of a heating portion that heats the material, setting the temperature of the heating portion to a first temperature in a state where the sheet manufacturing apparatus manufactures the sheet, and setting the temperature of the heating portion to a second temperature lower than the first temperature at a predetermined timing in a state where the sheet is not manufactured, or at a predetermined timing when a state of the sheet manufacturing apparatus is shifted to the state where the sheet is not manufactured.

According to the present invention, the temperature of the heating portion can be controlled to the second temperature lower than the first temperature in the state of manufacturing the sheet. Therefore, for example, when the heating portion is set to the second temperature in the standby state where the sheet is not manufactured, and the temperature is raised to the first temperature when the manufacture of the sheet is started, the manufacture of the sheet can be started more rapidly than when the heating portion is completely stopped. As a result, in the sheet manufacturing apparatus manufacturing the sheet, it is possible to reduce the time it takes the apparatus to be able to start the manufacture of the sheet from the stopped state by the method in which the decrease in energy efficiency is unlikely to occur.

BRIEF DESCRIPTION OF DRAWINGS

FIG. 10 is an explanatory table illustrating an example of an operation state of the sheet manufacturing apparatus.

FIG. 11 is a schematic table illustrating an example of data read from an IC.

DESCRIPTION OF EMBODIMENTS

Hereinafter, favorable embodiments of the present invention will be described in detail with reference to the drawings. The embodiments described below do not limit the contents of the present invention described in the aspects. In addition, not all of the configurations described below are necessarily essential configuration requirements of the present invention.

First Embodiment

1. Overall Configuration

Figure 1:
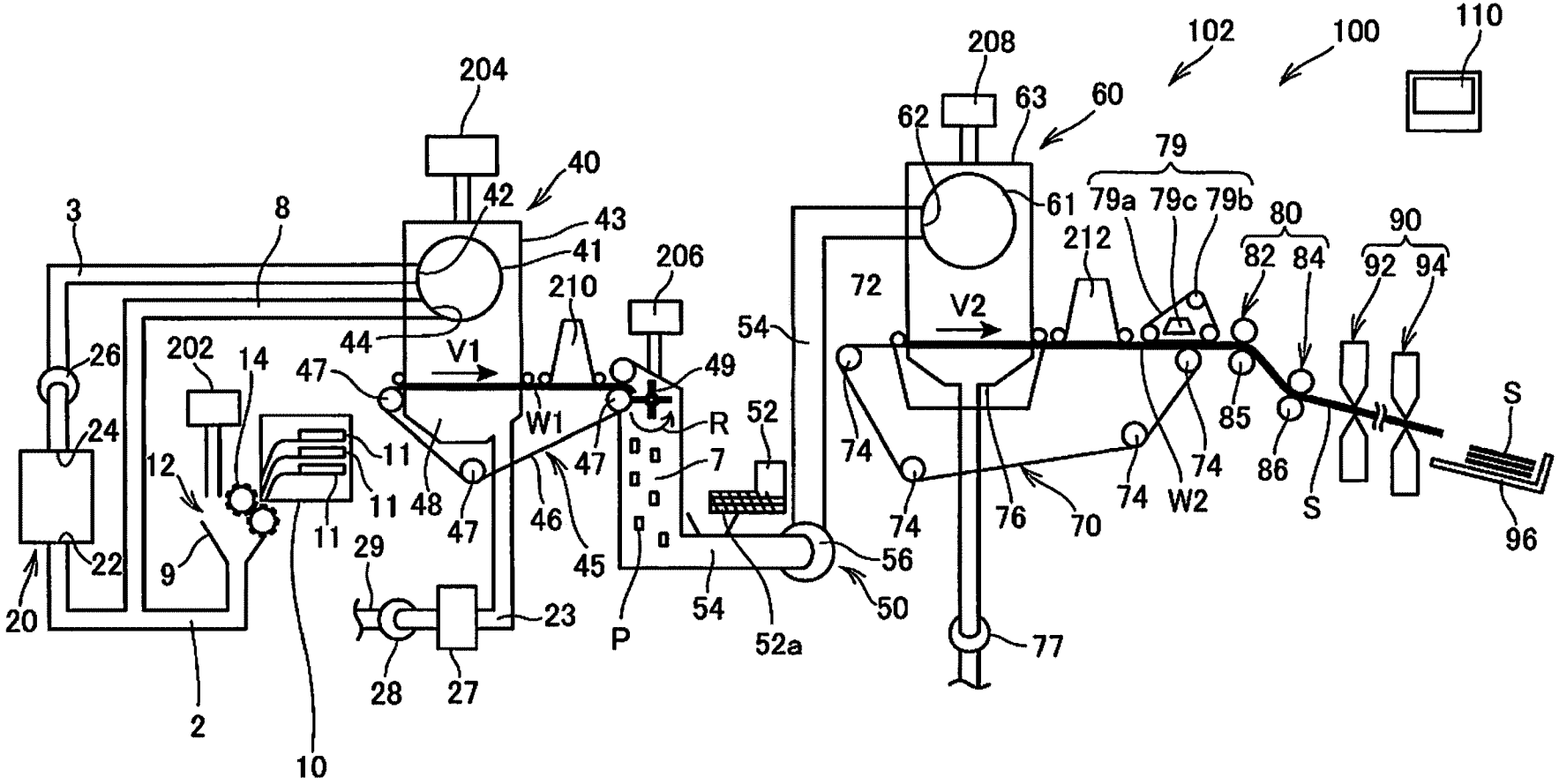
FIG. 1 is a schematic view illustrating a configuration of a sheet manufacturing apparatus according to a first embodiment.

FIG. 1 is a schematic view illustrating a configuration of a sheet manufacturing apparatus 100 according to a first embodiment to which the present invention is applied.

The sheet manufacturing apparatus 100 described in the present embodiment is an apparatus suitable for manufacturing a new sheet by defibrating and fiberizing a used waste sheet such as confidential sheet as a raw material, in a dry state, pressing, heating, and cutting, for example. By mixing various additives with the fiberized raw material, a bonding strength and whiteness of the sheet product may be improved, and functions such as color, smell, and flame retardancy may be added according to the application. In addition, by controlling the density, thickness, and shape of the sheet and molding the sheet, sheets of various thicknesses and sizes can be manufactured according to the application, such as office sheet of standard size such as A4 and A3, business card sheet, and the like.

The sheet manufacturing apparatus 100 is provided with a manufacturing portion 102 and a control device 110. 102 manufactures a sheet. The manufacturing portion 102 is provided with a supply portion 10, a coarse crushing portion 12, a defibrating portion 20, a sorting portion 40, a first web forming portion 45, a rotating body 49, a mixing portion 50, an accumulating portion 60, a second web forming portion 70, a transport portion 79, a sheet forming portion 80, and a cutting portion 90.

In addition, the sheet manufacturing apparatus 100 is provided with humidifying portions 202, 204, 206, 208, 210, and 212 for the purpose of humidifying the raw material and/or humidifying a space where the raw material moves. A specific configuration of these humidifying portions 202, 204, 206, 208, 210, and 212 is predetermined, and examples thereof include a steam type, a vaporization type, a warm air vaporization type, an ultrasonic type, or the like.

In the present embodiment, the humidifying portions 202, 204, 206, and 208 are configured to include a vaporization type or a warm air vaporization type humidifier. That is, the humidifying portions 202, 204, 206, and 208 have filters (not illustrated) that wet water, and supply humidified air with increased humidity by causing air to pass through the filters. In addition, the humidifying portions 202, 204, 206, and 208 may include heaters (not illustrated) that effectively increase the humidity of the humidified air.

In addition, in the present embodiment, the humidifying portion 210 and the humidifying portion 212 are configured to include ultrasonic humidifiers. That is, the humidifying portions 210 and 212 have vibrating portions (not illustrated) that atomize water, and supply mist generated by the vibrating portions.

The supply portion 10 supplies the raw material to the coarse crushing portion 12. The raw material from which the sheet manufacturing apparatus 100 manufactures the sheet may be a sheet containing fibers, and examples thereof include a paper, a pulp, a pulp sheet, a cloth containing a nonwoven fabric, or a textile, or the like. In the present embodiment, a configuration in which the sheet manufacturing apparatus 100 uses a waste sheet as the raw material is exemplified.

For example, the supply portion 10 is provided with a plurality of stackers 11 (accommodation portions) that accommodate the waste sheets (raw materials). In each of the stacker 11, the waste sheets are repeatedly accumulated. For example, in the supply portion 10, the waste sheets can be accommodated in different stackers 11 for each type. The supply portion 10 is provided with an automatic loading device that selects one of the plurality of stackers 11 and feeds the waste sheet from the selected stacker 11 to the coarse crushing portion 12. The stacker 11 selected by the supply portion 10 is specified by the control of the control device 110.

The coarse crushing portion 12 cuts (crushes) the raw material supplied by the supply portion 10 with a coarse crushing blade 14 to form a coarse crushed piece. The coarse crushing blade 14 cuts the raw material in air such as in the atmosphere (in air). For example, the coarse crushing portion 12 is provided with a pair of coarse crushing blades 14 cutting with the material interposed, and a drive portion rotating the coarse crushing blades 14, and can be configured similar to a so-called shredder. The shape and size of the coarse crushed piece are predetermined, and may be suitable for a defibrating treatment in the defibrating portion 20. For example, the coarse crushing portion 12 cuts the raw material into pieces of sheet having a size of 1 to several cm square or less.

The coarse crushing portion 12 has a chute (hopper) 9 receiving the coarse crushed piece cut and dropped by the coarse crushing blade 14. For example, the chute 9 has a tapered shape in which the width gradually narrows in the direction where the coarse crushed pieces flow (travelling direction). Therefore, the chute 9 can receive many coarse crushed pieces. A tube 2 communicating with the defibrating portion 20 is coupled to the chute 9, and the tube 2 forms a transport path for transporting the raw material (coarse crushed piece) cut by the coarse crushing blade 14 to the defibrating portion 20. The coarse crushed piece is collected by the chute 9 and transferred (transported) to the defibrating portion 20 through the tube 2.

Humidified air is supplied from the humidifying portion 202 to the chute 9 included in the coarse crushing portion 12 or in the vicinity of the chute 9. As a result, it is possible to suppress the phenomenon that the coarse crushed material cut by the coarse crushing blade 14 is adsorbed to the inner surface of the chute 9 or the tube 2 by static electricity. In addition, since the coarse crushed material cut by the coarse crushing blade 14 and the humidified (high humidity) air are transferred to the defibrating portion 20, the effect of suppressing adhesion of a defibrated material inside the defibrating portion 20 can also be expected. In addition, the humidifying portion 202 may supply the humidified air to the coarse crushing blade 14 to discharge the raw material supplied by the supply portion 10. In addition, the charge removal may be performed using an ionizer and the humidifying portion 202.

The defibrating portion 20 defibrates the coarse crushed material cut by the coarse crushing portion 12. More specifically, the defibrating portion 20 defibrates the raw material (coarse crushed piece) cut by the coarse crushing portion 12 to generate a defibrated material. Here, "to defibrate" refers to unravel a raw material (material to be defibrated) in which a plurality of fibers are bound into a fiber one by one. The defibrating portion 20 also has a function of separating substances such as resin particles, ink, toner, anti-smearing agent, and the like attached to the raw material from fibers.

The material passed through the defibrating portion 20 is referred to as "defibrated material". The "defibrated material" may contain resin (resin for bonding a plurality of fibers) particles separated from fibers when unraveling fibers, coloring agents such as ink and toner, or additives such as bleed inhibitor and paper strength enhancer in addition to unraveled defibrated fibers. The shape of unraveled defibrated material is a string or ribbon shape. The unraveled defibrated material may exist in a state not intertwined with other unraveled fiber (independent state), or may exist in a state of being intertwined with other unraveled defibrated material to form a lump (state of forming so-called "lump").

The defibrating portion 20 performs defibration in a dry method. Here, performing a treatment such as defibration in the air such as atmosphere (in air) rather than in liquid is referred to as the dry method. In the present embodiment, the defibrating portion 20 is configured to use an impeller mill. Specifically, the defibrating portion 20 is provided with a rotor (not illustrated) rotating at high speed, and a liner (not illustrated) located on an outer periphery of the rotor. The coarse crushed piece of the raw material cut by the coarse crushing portion 12 are defibrated by being interposed between the rotor of the defibrating portion 20 and the liner. The defibrating portion 20 generates an air flow by the rotation of the rotor. By the air flow, the defibrating portion 20 can suck the coarse crushed piece, which are raw materials, from the tube 2 and can transport the defibrated material to a discharge port 24. The defibrated material is fed from the discharge port 24 to a tube 3 and transferred to the sorting portion 40 via the tube 3.

As described above, the defibrated material generated by the defibrating portion 20 is transported from the defibrating portion 20 to the sorting portion 40 by the air flow generated by the defibrating portion 20. Furthermore, in the present embodiment, the sheet manufacturing apparatus 100 is provided with a defibrating portion blower 26 which is an air flow generating device, and the defibrated material is transported to the sorting portion 40 by the air flow generated by the defibrating portion blower 26. The defibrating portion blower 26 is attached to the tube 3, sucks air and the defibrated material from the defibrating portion 20, and blows air to the sorting portion 40.

The sorting portion 40 includes an introduction port 42 through which the defibrated material defibrated by the defibrating portion 20 and the air flow from the tube 3. The sorting portion 40 sorts the defibrated material to be introduced into the introduction port 42 according to the length of the fiber. Specifically, the sorting portion 40 sorts a defibrated material having a size of a predetermined size or less as a first sorted material, and a defibrated material larger than the first sorted material as a second sorted material among the defibrated materials defibrated by the defibrating portion 20. The first sorted material includes fibers or particles, and the second sorted material includes, for example, a large fiber, an undefibrated piece (coarse crushed piece not sufficiently defibrated), a lump in which defibrated fibers are aggregated or interwined, and the like.

In the present embodiment, the sorting portion 40 includes a drum portion 41 (sieve portion) and a housing portion (cover portion) 43 accommodating the drum portion 41.

The drum portion 41 is a sieve of a cylinder rotationally driven by a motor. The drum portion 41 includes a mesh (filter, screen) and functions as a sieve. By this mesh, the drum portion 41 sorts the first sorted material smaller than the size of a mesh sieve (opening) and the second sorted material larger than the mesh sieve. As the mesh of the drum portion 41, for example, a wire mesh, an expanded metal obtained by stretching a metal plate with a notch, and a punching metal having a hole formed in a metal plate by a pressing machine or the like can be used.

The defibrated material introduced into the introduction port 42 and the air flow are fed into the inside of the drum portion 41, and the first sorted material drops downward from the mesh of the drum portion 41 by the rotation of the drum portion 41. The second sorted material which cannot pass through the mesh of the drum portion 41 is flowed by the air flow flowing into the drum portion 41 from the introduction port 42, is led to the discharge port 44, and is fed to a tube 8.

The tube 8 couples the inside of the drum portion 41 and the tube 2. The second sorted material flowing through the tube 8 and the coarse crushed piece cut by the coarse crushing portion 12 flow through the tube 2 and are led to the introduction port 22 of the defibrating portion 20. As a result, the second sorted material is returned to the defibrating portion 20, and is defibrated.

In addition, the first sorted material sorted by the drum portion 41 is dispersed in the air through the mesh of the drum portion 41 and is descended toward a mesh belt 46 of the first web forming portion 45 located below the drum portion 41.

The first web forming portion 45 (separation portion) includes the mesh belt 46 (separation belt), a roller 47, and a suction portion (suction mechanism) 48. The mesh belt 46 is an endless belt and is suspended by three rollers 47 and is transported in a direction indicated by the arrow in the drawing by the movement of the rollers 47. The surface of the mesh belt 46 is configured to include a mesh in which openings of a predetermined size are arranged. Among the first sorted material descending from the sorting portion 40, fine particles of a size that passes through the mesh fall downwards the mesh belt 46, and fibers of a size that cannot pass through the mesh are accumulated on the mesh belt 46, and are transported in the direction of the arrow V1 with the mesh belt 46. The fine particles falling from the mesh belt 46 include relatively small particles and low density particles (resin particles, coloring agents, additives, and the like), and are removed materials that the sheet manufacturing apparatus 100 does not use for manufacturing the sheet S.

The mesh belt 46 moves at a speed V1 during the operation of manufacturing the sheet S. The transport speed V1 of the mesh belt 46 and the start and stop of transport by the mesh belt 46 are controlled by the control device 110.

Here, "during operation" means during operation except for a start control and a stop control of the sheet manufacturing apparatus 100 described later, and more specifically, refers to while the sheet S with a quality desired by the sheet manufacturing apparatus 100 is manufactured.

Therefore, the defibrated material subjected to the defibrating treatment in the defibrating portion 20 is sorted into the first sorted material and the second sorted material by the sorting portion 40, and the second sorted material is returned to the defibrating portion 20. In addition, the first web forming portion 45 removes the removed material from the first sorted material. The remainder of the first sorted material excluding the removed material is a material suitable for manufacturing the sheet S. This material is accumulated on the mesh belt 46 to form the first web W1.

The suction portion 48 sucks air from below the mesh belt 46. The suction portion 48 is coupled to a dust collection portion 27 (dust collection device) via a tube 23. The dust collection portion 27 separates the particulates from the air flow. A collection blower 28 is installed downstream of the dust collection portion 27, and the collection blower 28 functions as a dust collection suction portion that sucks air from the dust collection portion 27. In addition, the air discharged by the collection blower 28 is discharged out of the sheet manufacturing apparatus 100 through a tube 29.

In this configuration, air is sucked from the suction portion 48 through the dust collection portion 27 by the collection blower 28. In the suction portion 48, the fine particles passing through the mesh of the mesh belt 46 are sucked with the air, and are sent to the dust collection portion 27 through the tube 23. The dust collection portion 27 separates and accumulates the fine particles passed through the mesh belt 46 from the air flow.

Therefore, the fibers from which the removed materials are removed from the first sorted material are accumulated on the mesh belt 46 to form the first web W1. The suction by the collection blower 28 promotes the formation of the first web W1 on the mesh belt 46, and the removed material is rapidly removed.

Humidified air is supplied by the humidifying portion 204 to the space including the drum portion 41. The humidified air humidifies the first sorted material inside the sorting portion 40. As a result, the adhesion of the first sorted material to the mesh belt 46 by electrostatic force can be weakened, and the first sorted material can be easily separated from the mesh belt 46. Furthermore, it is possible to suppress that the first sorted material adheres to the rotating body 49 and the inner wall of the housing portion 43 by electrostatic force. In addition, the removed material can be efficiently sucked by the suction portion 48.

In the sheet manufacturing apparatus 100, the configuration for sorting and separating the first defibrated material and the second defibrated material is not limited to the sorting portion 40 provided with the drum portion 41. For example, a configuration may be adopted in which the defibrated material subjected to the defibrating treatment by the defibrating portion 20 is classified by a classifier. For example, as the classifier, a cyclone classifier, an elbow jet classifier, or an Eddie classifier can be used. Using these classifiers, it is possible to sort and separate the first sorted material and the second sorted material. Furthermore, the above classifier can realize a configuration for separating and removing the removed material including relatively small materials of defibrated materials and low density materials (resin particles, coloring agents, additives, and the like). For example, the fine particles contained in the first sorted material may be removed from the first sorted material by the classifier. In this case, for example, the second sorted material may be returned to the defibrating portion 20, the removed material may be collected by the dust collection portion 27, and the first sorted material removing the removed material may be sent to a tube 54.

On the downstream of the sorting portion 40 in the transport path of the mesh belt 46, air containing mist is supplied by the humidifying portion 210. Mist, which is fine particles of water generated by the humidifying portion 210, descends toward the first web W1 to supply moisture to the first web W1. As a result, the amount of water contained in the first web W1 is adjusted, and adsorption of fibers to the mesh belt 46 due to static electricity can be suppressed.

The sheet manufacturing apparatus 100 is provided with the rotating body 49 that divides the first web W1 accumulated on the mesh belt 46. The first web W1 is separated from the mesh belt 46 at a position where the mesh belt 46 is folded back by the roller 47 and is divided by the rotating body 49.

The first web W1 is a soft material in which the fibers are accumulated to form a web, and the rotating body 49 loosens the fibers of the first web W1 and processes the resin in a state easy to mix in the mixing portion 50.

Although the configuration of the rotating body 49 is predetermined, the configuration can have a rotating blade shape having a plate-shaped blade and rotates in the present embodiment. The rotating body 49 is disposed at a position where the first web W1 separated from the mesh belt 46 and the blade are in contact with each other. By rotation of the rotating body 49 (for example, rotation in the direction indicated by the arrow R in the drawing), the blade collides with the first web W1 which is separated and transported from the mesh belt 46 and is divided to generate a subdivided body P.

The rotating body 49 is preferably installed at a position where the blades of the rotating body 49 do not collide with the mesh belt 46. For example, the distance between a tip end of the blade of the rotating body 49 and the mesh belt 46 can be 0.05 mm or more and 0.5 mm or less. In this case, the rotating body 49 can efficiently divide the first web W1 without damaging the mesh belt 46.

The subdivided body P divided by the rotating body 49 descend inside a tube 7 and are transferred (transported) to the mixing portion 50 by the air flow flowing inside the tube 7.

In addition, humidified air is supplied to the space including the rotating body 49 by the humidifying portion 206. As a result, it is possible to suppress the phenomenon in which the fibers are adsorbed to the inside of the tube 7 and the blades of the rotating body 49 by static electricity. In addition, since the air with high humidity is supplied to the mixing portion 50 through the tube 7, the influence of static electricity can be suppressed in the mixing portion 50.

The mixing portion 50 is provided with an additive supply portion 52 supplying an additive containing a resin, the tube 54 communicating with the tube 7 and through which an air flow containing the subdivided body P flows, and a mixing blower 56. The subdivided body P is fibers from which the removed material is removed from the first sorted material passed through the sorting portion 40 as described above. The mixing portion 50 mixes the additive containing the resin with the fiber forming the subdivided body P. For example, the additive acts as a binding material to bind the fibers.

In the mixing portion 50, an air flow is generated by the mixing blower 56, and is transported in the tube 54 while mixing the subdivided body P and the additive. In addition, the subdivided body P is loosened in the process of flowing inside the tube 7 and the tube 54, and is finer and fibrous.

Figure 6:
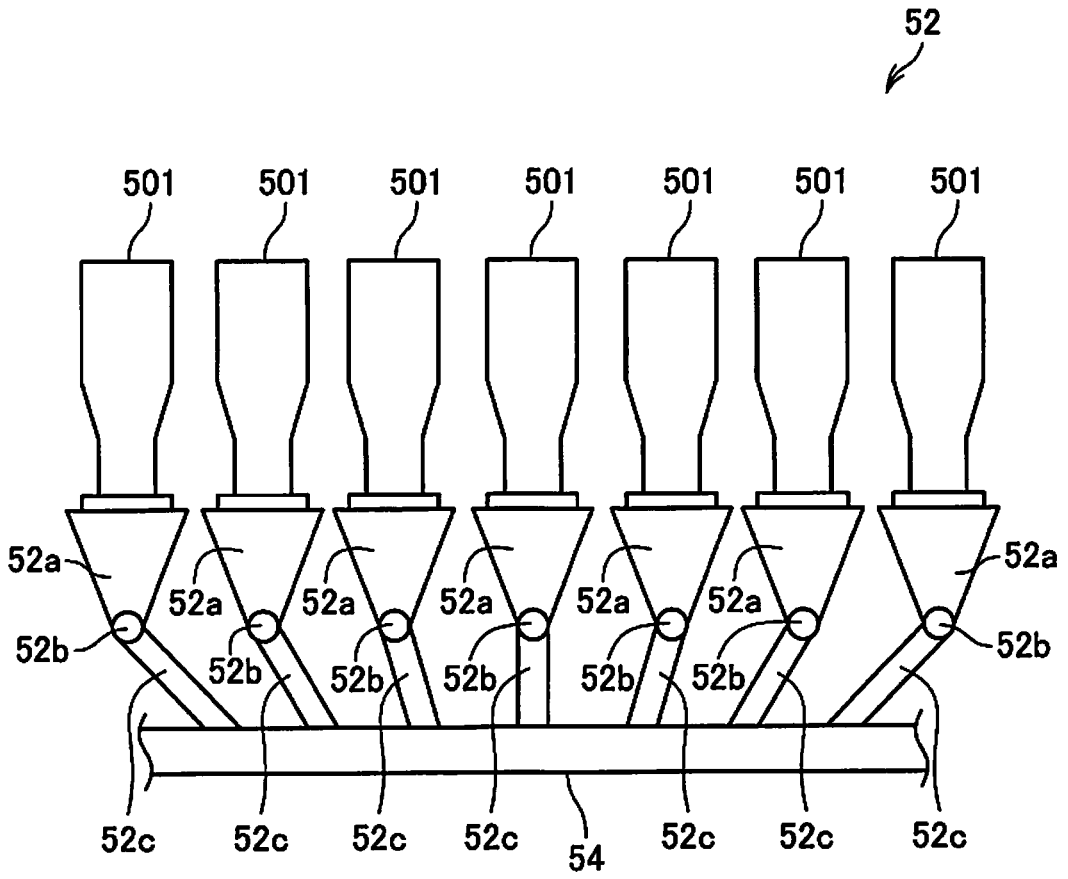
FIG. 6 is a schematic view illustrating a configuration of an additive supply portion.

An additive cartridge 501 (cartridge) accumulating the additive is detachably attached to the additive supply portion 52, as illustrated in FIG. 6. The additive supply portion 52 supplies the additive in the additive cartridge 501 to the tube 54. The configuration may be such that the additive cartridge 501 attached to the additive supply portion 52 is replenished with the additive. The configuration of the additive supply portion 52 will be described later with reference to FIG. 6.

The additive contained in the additive cartridge 501 and supplied by the additive supply portion 52 includes a resin for binding a plurality of fibers. The resin contained in the additive is a thermoplastic resin or a thermosetting resin, and examples thereof include AS resin, ABS resin, polypropylene, polyethylene, polyvinyl chloride, polystyrene, acrylic resin, polyester resin, polyethylene terephthalate, polyphenylene ether, polybutylene terephthalate, nylon, polyamide, polycarbonate, polyacetal, polyphenylene sulfide, polyether ether ketone, and the like. These resins may be used alone or as a mixture as appropriate. That is, the additive may contain a single substance, may be a mixture, or may contain a plurality of types of the particles, each consisting of a single or a plurality of substances. In addition, the additive may be in a fibrous form or powder form.

The resin contained in the additive is melted by heating to bind a plurality of fibers. Therefore, in a state where the resin is mixed with the fibers, the fibers are not bonded to each other in the state where the resin is not heated to the melting temperature.

In addition, the additive supplied by the additive supply portion 52 may contain a coloring agent for coloring the fibers, an aggregation inhibitor for suppressing aggregation of the fibers or aggregation of the resins, and a flame retardant for causing fibers less flammable, in addition to the resin binding the fibers, depending on the type of the sheet to be manufactured. In addition, the additive not containing the coloring agent may be colorless, may be light enough to be considered colorless, or may be white.

Due to the air flow generated by the mixing blower 56, the subdivided body P descending in the tube 7 and the additive supplied by the additive supply portion 52 are sucked inside the tube 54 and pass through inside the mixing blower 56. By the action of the air flow generated by the mixing blower 56 and/or the action of the rotating portion of the mixing blower 56 such as the blades, the fibers forming the subdivided body P and the additives are mixed, and this mixture (mixture of the first sorted material and the additive) is transferred to the accumulating portion 60 through the tube 54.

The mechanism mixing the first sorted material and the additive is not particularly limited, and may be a mechanism in which stirring is performed by a blade rotating at a high speed, may be a mechanism using the rotation of the container such as a V-type mixer, or these mechanisms may be installed before or after the mixing blower 56.

The accumulating portion 60 accumulates the defibrated material defibrated by the defibrating portion 20. More specifically, the accumulating portion 60 introduces the mixture passed through the mixing portion 50 from the introduction port 62, loosens the intertwined defibrated material (fibers), and causes the mixture to descend in the air while dispersing. Furthermore, when the resin of the additive supplied from the additive supply portion 52 is fibrous, the accumulating portion 60 loosens the intertwined resin. As a result, the accumulating portion 60 can accumulate the mixture uniformly on the second web forming portion 70.

The accumulating portion 60 includes a drum portion 61 and a housing portion (cover portion) 63 accommodating the drum portion 61. The drum portion 61 is a sieve of a cylinder rotationally driven by a motor. The drum portion 61 includes a mesh (filter, screen) and functions as a sieve. By this mesh, the drum portion 61 causes fibers and particles smaller than the mesh sieve (opening) to pass through and drop from the drum portion 61. For example, a configuration of the drum portion 61 is the same as a configuration of the drum portion 41.

In addition, the "sieve" of the drum portion 61 may not have a function which sorts a specific target object. That is, the "sieve" used as the drum portion 61 means a portion provided with the mesh, and the drum portion 61 may descend all of the mixture introduced to the drum portion 61.

The second web forming portion 70 is disposed below the drum portion 61. The second web forming portion 70 accumulates passing materials passed through the accumulating portion 60 to form a second web W2. For example, the second web forming portion 70 includes a mesh belt 72, the roller 74, and a suction mechanism 76. The accumulating portion 60 and the second web forming portion 70 correspond to a web forming portion. In addition, the drum portion 61 corresponds to a sieve portion, and the second web forming portion 70 (in particular, mesh belt 72) corresponds to an accumulating portion.

The mesh belt 72 is an endless belt and is suspended by a plurality of rollers 74, and is transported in the direction indicated by the arrow V2 in the drawing by the movement of the rollers 74. For example, the mesh belt 72 is made of metal, resin, cloth, non-woven fabric, or the like. The surface of the mesh belt 72 is configured to include a mesh in which openings of a predetermined size are arranged. Among the fibers and particles descending from the drum portion 61, fine particles of a size passing through the mesh fall below the mesh belt 72, fibers of a size which cannot pass through the mesh are accumulated on the mesh belt 72, and transported in the direction of the arrow with the mesh belt 72. The mesh belt 72 moves at a constant speed V2 during the operation of manufacturing the sheet S. The operation is as described above.

A moving speed V2 of the mesh belt 72 can be regarded as the speed at which the second web W2 is transported, and the speed V2 can be referred to as a transport speed of the second web W2 at the mesh belt 72.

The mesh of the mesh belt 72 is fine and can be sized so as not to pass most of the fibers and particles descending from the drum portion 61.

The suction mechanism 76 is provided below the mesh belt 72 (side opposite to accumulating portion 60). The suction mechanism 76 is provided with a suction blower 77, and can generate an air flow (air flow from the accumulating portion 60 toward the mesh belt 72) directed downward to the suction mechanism 76 by the suction force of the suction blower 77.

The suction mechanism 76 sucks the mixture dispersed in the air by the accumulating portion 60 onto the mesh belt 72. As a result, the formation of the second web W2 on the mesh belt 72 can be promoted, and the discharge speed from the accumulating portion 60 can be increased. Furthermore, the suction mechanism 76 can form a downflow in a dropping path of the mixture, and can prevent intertwined of defibrated substances and additives during dropping.

The suction blower 77 (accumulation suction portion) may discharge the air sucked from the suction mechanism 76 to the outside of the sheet manufacturing apparatus 100 through a collection filter (not illustrated). Alternatively, the air sucked by the suction blower 77 may be sent to the dust collection portion 27, and the removal material contained in the air sucked by the suction mechanism 76 may be collected.

Humidified air is supplied from the humidifying portion 208 to a space including the drum portion 61. By the humidified air, the inside of the accumulating portion 60 can be humidified, the adhesion of fibers and particles to the housing portion 63 by electrostatic force can be suppressed, the fibers and particles can be rapidly descended to the mesh belt 72, and the second web W2 having a preferable shape can be formed.

As described above, by passing through the accumulating portion 60 and the second web forming portion 70 (web forming step), the second web W2 in a soft and bloated state is formed with a large amount of air. The second web W2 accumulated on the mesh belt 72 is transported to the sheet forming portion 80.

In the transport path of the mesh belt 72, air containing mist is supplied to the downstream of the accumulating portion 60 by the humidifying portion 212. As a result, the mist which the humidifying portion 212 generates is supplied to the second web W2, and the moisture content which the second web W2 contains is adjusted. As a result, adsorption of fibers to the mesh belt 72 due to static electricity can be suppressed.

The sheet manufacturing apparatus 100 is provided with the transport portion 79 transporting the second web W2 on the mesh belt 72 to the sheet forming portion 80. For example, the transport portion 79 includes a mesh belt 79*a*, a roller 79*b*, and a suction mechanism 79*c*.

The suction mechanism 79*c* is provided with an intermediate blower 318 (FIG. 7) and generates an upward air flow on the mesh belt 79*a* by the suction force of the intermediate blower 318. The air flow sucks the second web W2, and the second web W2 is separated from the mesh belt 72 and adsorbed to the mesh belt 79*a*. The mesh belt 79*a* is moved by the rotation of the roller 79*b* and transports the second web W2 to the sheet forming portion 80.

As described above, the transport portion 79 separates the second web W2 formed on the mesh belt 72 from the mesh belt 72 and transports the second web W2.

The sheet forming portion 80 forms the sheet S from the accumulated material accumulated in the accumulating portion 60. More specifically, the sheet forming portion 80 presses and heats the second web W2 (accumulated material) accumulated on the mesh belt 72 and transported by the transport portion 79 to form the sheet S. In the sheet forming portion 80, a plurality of fibers in the mixture are bound to each other via the additive (resin) by applying heat to the fibers of the defibrated material contained in the second web W2 and the additive. The sheet forming portion 80 corresponds to a sheet forming portion and a maximum load transport portion.

The sheet forming portion 80 is provided with a pressurizing portion 82 pressing the second web W2, and a heating portion 84 heating the second web W2 pressed by the pressurizing portion 82.

The pressurizing portion 82 includes a pair of calender rollers 85 (pressure rollers), and interposes and presses the second web W2 with a predetermined nip pressure. The second web W2 is reduced in thickness by being pressurized, and the density of the second web W2 is increased. One of the pair of calender rollers 85 is a drive roller driven by a pressurizing portion drive roller 335 (FIG. 7), and the other is a driven roller. The calender roller 85 is rotated by the drive force of the pressurizing portion drive roller 335, and transports the second web W2 having a high density by the pressure toward the heating portion 84.

The heating portion 84 can be configured using, for example, a heating roller (heater roller), a heat press molding machine, a hot plate, a hot air blower, an infrared heater, and a flash heater. In the present embodiment, the heating portion 84 is provided with a pair of heating rollers 86. The heating roller 86 is heated to a preset temperature by a heater provided internally or externally. One of the pair of heating rollers 86 is a driving roller driven by a heating portion drive motor 337 (FIG. 7), and the other is a driven roller. The heating roller 86 interposes the sheet S pressed by the calender roller 85 and applies heat to form the sheet S. The heating roller 86 is rotated by the drive force of the heating portion drive motor 337 and transports the sheet S toward the cutting portion 90.

The number of calender rollers 85 provided in the pressurizing portion 82 and the number of heating rollers 86 provided in the heating portion 84 are not particularly limited.

In addition, in a step of manufacturing the sheet S by the sheet manufacturing apparatus 100, the boundary between the second web W2 and the sheet S is predetermined. In the present embodiment, in the sheet forming portion 80 that processes the second web W2 to form the sheet S, the second web W2 is pressed by the pressurizing portion 82, and the second web pressed by the pressurizing portion 82 is further heated by the heating portion 84 and referred to as a sheet S. That is, a sheet in which fibers are bound by an additive is referred to as a sheet S. The sheet S is transported to the cutting portion 90.

The cutting portion 90 cuts the sheet S formed by the sheet forming portion 80. In the present embodiment, the cutting portion 90 includes a first cutting portion 92 cutting the sheet S in a direction intersecting the transport direction of the sheet S (F in the drawing), and a second cutting portion 94 cutting the sheet S in a direction parallel to the transport direction F. The second cutting portion 94 cuts, for example, the sheet S passed through the first cutting portion 92.

As described above, a single-cut sheet S of a predetermined size is formed. The cut single-cut sheet S is discharged to a discharge portion 96. The discharge portion 96 is provided with a tray or stacker on which the sheet S having a predetermined size is placed.

In the above configuration, the humidifying portions 202, 204, 206, and 208 may be configured to include a single vaporization type humidifier. In this case, the humidified air generated by one humidifier may be branched and supplied to the coarse crushing portion 12, the housing portion 43, the tube 7, and the housing portion 63. This configuration can be easily realized by branching and installing a duct (not illustrated) for supplying the humidified air. In addition, as a matter of course, the humidifying portions 202, 204, 206, and 208 can be configured to include two or three vaporization type humidifiers.

In addition, in the above configuration, the humidifying portions 210 and 212 may be configured to include one ultrasonic type humidifier, or may be configured to include two ultrasonic type humidifiers. For example, air containing mist generated by one humidifier can be branched and supplied to the humidifying portion 210 and the humidifying portion 212.

In addition, the blowers provided in the above-described sheet manufacturing apparatus 100 are not limited to the defibrating portion blower 26, the collection blower 28, the mixing blower 56, the suction blower 77, and the middle blower 318. For example, as a matter of course, a fan can be provided in the duct for assisting each blower described above.

In addition, in the above configuration, although the coarse crushing portion 12 first crushes the raw material and manufactures the sheet S from the crushed raw material, for example, the sheet S can be manufactured using fibers as a raw material.

For example, a configuration may be such that the fibers equivalent to the defibrated material subjected to the defibrating treatment by the defibrating portion 20 can be input to the drum portion 41 as a raw material. In addition, a configuration may be such that the fiber equivalent to the first sorted material separated from the defibrated material can be input to the tube 54 as a raw material. In this case, the sheet S can be manufactured by supplying the sheet manufacturing apparatus 100 with fibers obtained by processing waste sheet, pulp, and the like.

2. Configuration of Heating Portion

The sheet manufacturing apparatus 100 heats and presses the second web W2 (accumulated material formed by the accumulating portion 60) in the above-described sheet forming portion 80 (heating portion 84) to form the sheet S. In the example of FIG. 1, the heating portion 84 is simplified and illustrated as a pair of heating rollers 86. Hereinafter, the heating portion 84 of the sheet manufacturing apparatus 100 of the present embodiment will be described in detail.

Figure 2:
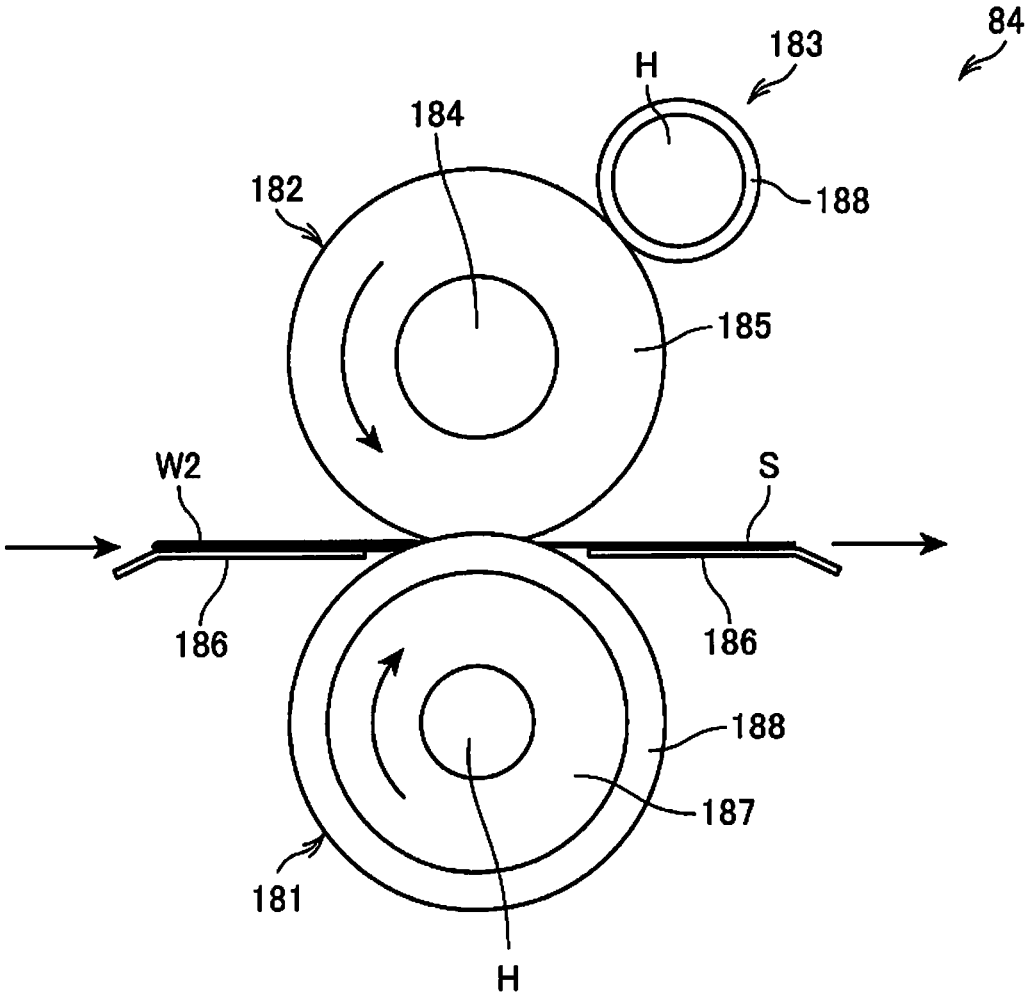
FIG. 2 is a schematic view illustrating a configuration of a heating portion at a first position.
Figure 3:
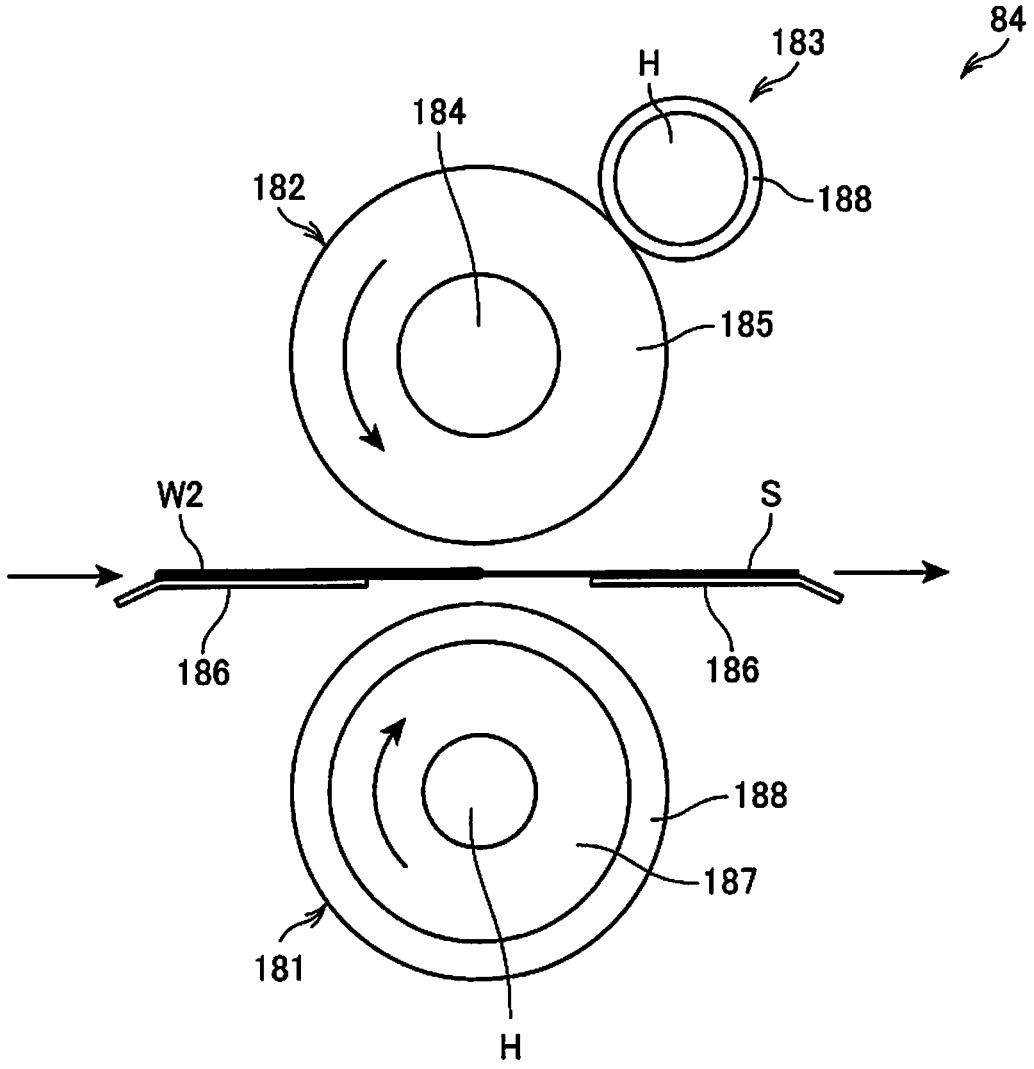
FIG. 3 is a schematic view illustrating a configuration of a heating portion at a second position.

FIGS. 2 and 3 are views schematically illustrating an example of the heating portion 84 of the present embodiment. The heating portion 84 includes a rotatable first rotating body 181, a rotatable second rotating body 182, and a heating body 183. Each of the first rotating body 181 and the second rotating body 182 has a roller shape having an outer peripheral surface that moves with rotation, and the second web W2 is held between the first rotating body 181 and the second rotating body 182 and heated and pressurized to form the sheet S. In addition, the heating body 183 is disposed so as to heat the outer peripheral surface of the second rotating body 182. Each of the first rotating body 181 and the heating body 183 is a heating roller having a heat source H (for example, halogen heater) inside. Instead of heating the second rotating body 182 by the heating body 183, the second rotating body 182 may be heated by a non-contact heater (for example, infrared heater or carbon heater). Each heat source H of the heating portion 84 generates heat under the control of the control device 110 to heat the first rotating body 181 and the second rotating body 182. In addition, the heating portion 84 includes a temperature sensor 309 (FIG. 7) that detects the temperature of the first rotating body 181 and the second rotating body 182 (for example, temperature of the outer peripheral surface). The control device 110 can acquire the detection value of the temperature sensor 309.

The second rotating body 182 is configured to include a core metal 184 at the center of rotation and a soft body 185 disposed so as to surround the periphery thereof. The core metal 184 is made of metal such as aluminum, iron, stainless steel and the like, and the soft body 185 is made of rubber such as silicone rubber and urethane rubber. In addition, the first rotating body 181 and the heating body 183 are each formed of a hollow metal core metal 187, and a fluorine-coated release layer 188 is provided on the surface thereof.

The heating portion 84 of the present embodiment is configured to be displaceable between the first position for the first rotating body 181 and the second rotating body 182 to hold the web W and heat and press the web W (refer to FIG. 2), and the second position where the first rotating body 181 and the second rotating body 182 are separated from each other (refer to FIG. 3). The first position can be referred to as a nip position where the first rotating body 181 and the second rotating body 182 can interpose the second web W2. On the other hand, the second position can be referred to as a position where the first rotating body 181 and the second rotating body 182 are separated from each other and the nip is released.

The sheet manufacturing apparatus 100 of the present embodiment is provided with a displacement mechanism for displacing the position of the heating portion 84. The displacement mechanism may displace either one of the first rotating body 181 and the second rotating body 182, or may displace both the first rotating body 181 and the second rotating body 182. As illustrated in FIGS. 2 and 3, by providing a supporting portion 186 (guide) supporting the second web W2 in the vicinity of the first rotating body 181 and the second rotating body 182, the first rotating body 181 and the second rotating body 182 may not be in contact with the second web W2 at the second position. The supporting portion 186 is provided at each of a position on the upstream of the transport direction and a position on the downstream of the transport direction of the second web W2 with respect to the interposing portion (nip portion) of the first rotating body 181 and the second rotating body 182.

Figure 4:
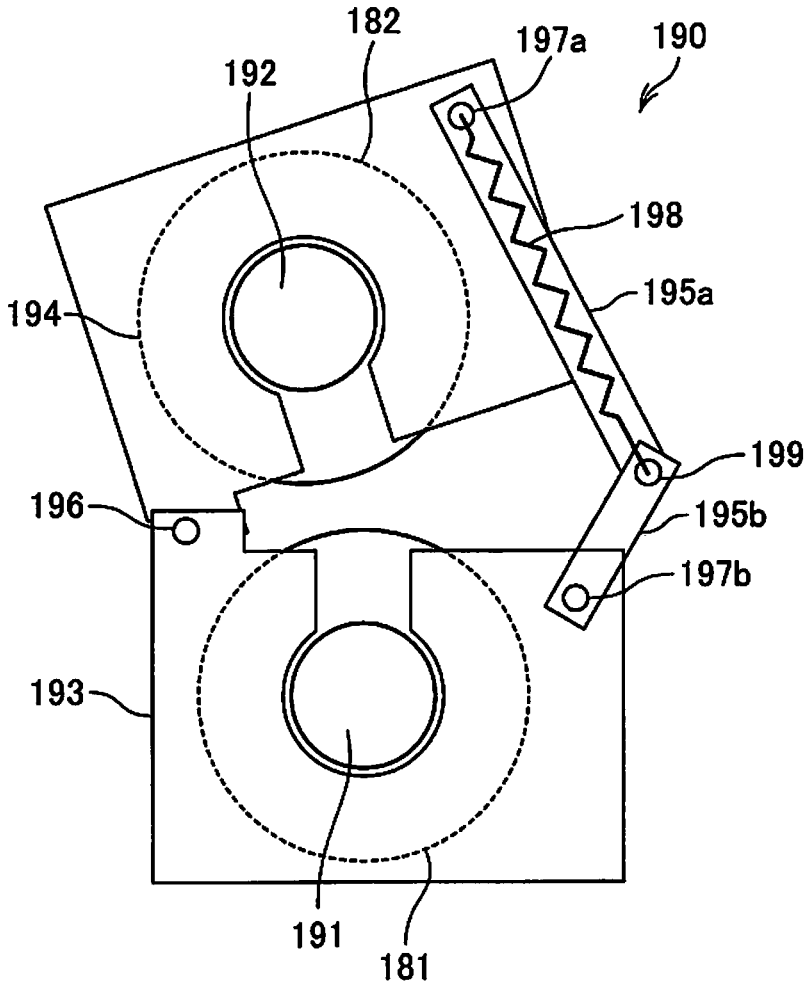
FIG. 4 is a schematic view illustrating an example of a displacement mechanism.
Figure 5:
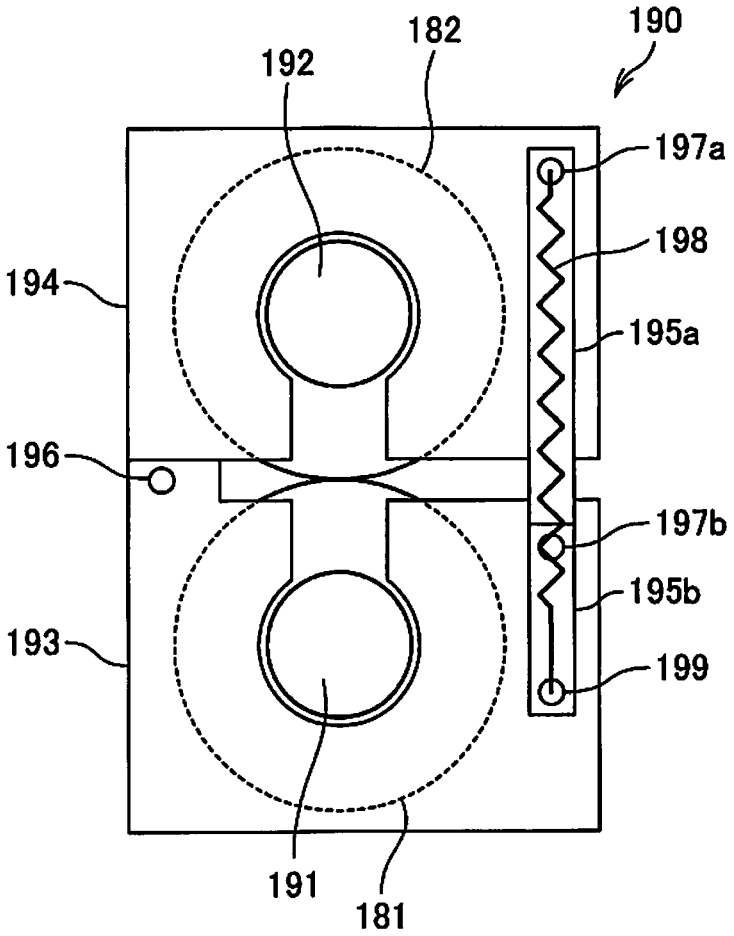
FIG. 5 is a schematic view illustrating an example of a displacement mechanism.

FIGS. 4 and 5 are views schematically illustrating an example of a displacement mechanism of the present embodiment.

A displacement mechanism 190 includes a first bearing portion 193 for rotatably supporting a rotating shaft 191 of the first rotating body 181, a second bearing portion 194 for rotatably supporting a rotating shaft 192 of the second rotating body 182, a first rod 195*a*, and a second rod 195*b*. The first bearing portion 193 and the second bearing portion 194 are rotatably (relatively movable) coupled to each other around a rotation shaft 196. One end side of the first rod 195*a* is provided on the second bearing portion 194 so as to be rotatable around a rotation shaft 197*a*, and one end side of the second rod 195*b* is provided on the first bearing portion 193 so as to be rotatable around a rotation shaft 197*b*. A biasing member 198 (spring) is provided on the first rod 195*a*. One end of the biasing member 198 is coupled to the rotation shaft 197*a*, and the other end of the biasing member 198 is coupled to the other end 199 of the second rod 195*b*. The displacement mechanism 190 has a drive portion that rotationally drives the second rod 195*b* around the rotation shaft 197*b*.

FIG. 4 illustrates a state where the heating portion 84 is in the second position, and FIG. 5 illustrates a state where the heating portion 84 is in the first position. When the second rod 195*b* is rotated clockwise in the state illustrated in FIG. 4 (second position), the first rotating body 181 and the second rotating body 182 are displaced to the first position where the first rotating body 181 and the second rotating body 182 are in contact with each other, as illustrated in FIG. 5. At this time, the first bearing portion 193 (first rotating body 181) is biased toward the second bearing portion 194 (second rotating body 182) by the biasing member 198, and the second bearing portion 194 is biased toward the first bearing portion 193. In the first position, the first rotating body 181 and the second rotating body 182 may not be in contact with each other as long as the first rotating body 181 and the second rotating body 182 can interpose, heat, and press the second web W2.

In addition, when the second rod 195*b* is rotated counterclockwise in the state illustrated in FIG. 5 (first position), the first rotating body 181 and the second rotating body 182 are displaced to a second position where the first rotating body 181 and the second rotating body 182 are separated from each other.

The displacement mechanism 190 illustrated in FIGS. 4 and 5 is driven by a roller moving portion 341 (FIG. 7) provided in the sheet manufacturing apparatus 100, and is displaceable to the first position of FIG. 4 and the second position of FIG. 5. For example, the roller moving portion 341 is configured to include a motor, an actuator, or the like, operates according to the control of the control device 110, and functions as the above-described drive portion. That is, in the present embodiment, the roller moving portion 341 rotates the second rod 195*b* around the rotation shaft 197*b* to switch the heating portion 84 between the first position and the second position.

Figure 7:
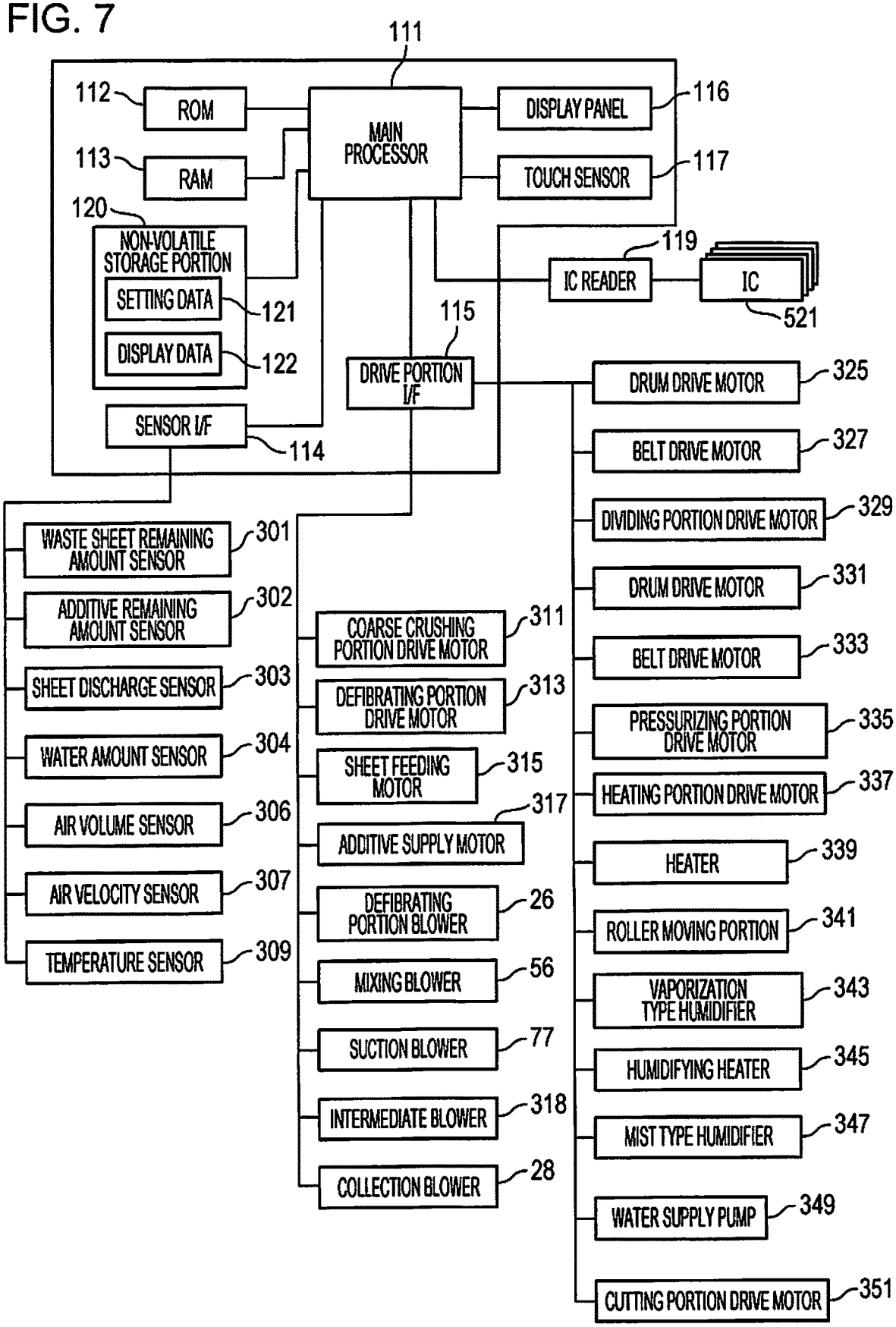
FIG. 7 is a block diagram illustrating a configuration of a control system of the sheet manufacturing apparatus.

The heating portion 84 of the present embodiment is configured such that the first rotating body 181 and the second rotating body 182 can be rotationally driven at the second position. The sheet manufacturing apparatus 100 according to the present embodiment is provided with the drive portion that rotationally drives the first rotating body 181, and a transmission mechanism transmitting the drive force by the drive portion to the second rotating body 182 at the second position without transmitting the drive force by the drive portion to the second rotating body 182 at the first position. For example, the drive portion is the heating portion drive motor 337 (FIG. 7). In addition, as the transmission mechanism, a link or a gear that transmits the drive force of the heating portion drive motor 337 to the first rotating body 181 or the second rotating body 182 can be used.

3. Composition of Additive Supply Portion

FIG. 6 is a schematic view illustrating a configuration of the additive supply portion 52.

The additive supply portion 52 is provided with the additive cartridge 501 as an additive accommodation portion accommodating the additive containing the resin. The additive cartridge 501 is formed in a box shape having a hollow inside, and is attached to the top of the discharge portion 52*a* of the additive supply portion 52. In the state where the additive cartridge 501 is attached, the discharge portion 52*a* communicates with the internal space of the additive cartridge 501, and the additive in the additive cartridge 501 flows down to the discharge portion 52*a*.

The discharge portion 52*a* is coupled to the tube 54 via a supply tube 52*c*, and the additive flows from the discharge portion 52*a* to the tube 54. A supply adjustment portion 52*b* is disposed between the discharge portion 52*a* and the supply tube 52*c*. The supply adjustment portion 52*b* is a mechanism that adjusts the amount of additive flowing from the discharge portion 52*a* into the supply tube 52*c*. For example, the supply adjustment portion 52*b* can be configured to include a shutter (not illustrated) that stops the inflow of the additive from the discharge portion 52*a* to the supply tube 52*c*, and a screw feeder (not illustrated) that feeds the additive from the discharge portion 52*a* to the supply tube 52*c* with the shutter open, and the like. In addition, the supply adjustment portion 52*b* may be provided with a mechanism adjusting the opening degree of the shutter.

A plurality of additive cartridges 501 can be attached to the additive supply portion 52, and the discharge portion 52*a*, the supply adjustment portion 52*b*, and the supply tube 52*c* are provided corresponding to the respective additive cartridges 501. In the present embodiment, seven additive cartridges 501 can be attached to the additive supply portion 52. The type of additive contained in each of the additive cartridges 501 is predetermined. For example, each of a yellow additive, a magenta additive, and a cyan additive can be supplied from the additive supply portion 52 to the tube 54 by attaching the additive cartridge 501 containing the different color additives, respectively. In addition, an additive cartridge 501 containing a white additive, a colorless (plain) additive, and the like may be attached, or an additive cartridge 501 containing an additive of another color may be attached.

The additive supply portion 52 can supply an additive from any one or more of the additive cartridges 501 among the plurality of additive cartridges 501 attached to the additive supply portion 52. For example, the control device 110 controls the additive supply portion 52, to supply the additive from the additive cartridge 501 containing the yellow additive and the additive cartridge 501 containing the cyan additive. Therefore, a green sheet S can be manufactured.

4. Control System Configuration

FIG. 7 is a block diagram illustrating a configuration of a control system of the sheet manufacturing apparatus 100.

The control device 110 provided in the sheet manufacturing apparatus 100 includes a main processor 111 that controls each part of the sheet manufacturing apparatus 100. The control device 110 is provided with a read only memory (ROM) 112 and a random access memory (RAM) 113 coupled to the main processor 111. The main processor 111 is an arithmetic processing unit such as a central processing unit (CPU), and controls each part of the sheet manufacturing apparatus 100 by executing a basic control program stored in the ROM 112. The main processor 111 may be configured as a system chip including peripheral circuits such as the ROM 112 and the RAM 113, and other IP cores.

The ROM 112 stores programs executed by the main processor 111 in a non-volatile manner. The RAM 113 forms a work area used by the main processor 111, and temporarily stores programs to be executed by the main processor 111 and data to be processed.

The non-volatile storage portion 120 stores programs executed by the main processor 111 and data processed by the main processor 111. The non-volatile storage portion 120 stores setting data 121 and display data 122, for example. The setting data 121 includes data for setting the operation of the sheet manufacturing apparatus 100. For example, the setting data 121 includes data such as the characteristics of various sensors provided in the sheet manufacturing apparatus 100, and a threshold used in the treatment in which the main processor 111 detects an abnormality based on detection values of the various sensors. The display data 122 is data of a screen that the main processor 111 causes a display panel 116 to display. The display data 122 may be fixed image data, or may be data for setting a screen display displaying data generated or acquired by the main processor 111.

The display panel 116 is a display panel such as a liquid crystal display, and is installed in front of a casing (main body, not illustrated) of the sheet manufacturing apparatus 100, for example. The display panel 116 displays the operation state of the sheet manufacturing apparatus 100, various setting values, a warning display, and the like according to the control of the main processor 111.

A touch sensor 117 detects a touch (contact) operation or a pressing operation. For example, the touch sensor 117 is a pressure sensing type or capacitance type sensor having a transparent electrode, and is disposed so as to overlap the display surface of the display panel 116. When the touch sensor 117 detects an operation, the touch sensor 117 outputs operation data including the operation position and the number of the operation positions to the main processor 111. The main processor 111 detects an operation on the display panel 116 by the output of the touch sensor 117, and acquires an operation position. The main processor 111 realizes a graphical user interface (GUI) operation based on the operation position detected by the touch sensor 117 and display data 122 being displayed on the display panel 116.

The control device 110 is coupled to sensors installed in each part of the sheet manufacturing apparatus 100 via a sensor interface (I/F) 114. The sensor I/F 114 is an interface obtaining a detection value output from the sensor and inputting the detection value to the main processor 111. The sensor I/F 114 may be provided with an analog/digital (A/D) converter that converts an analog signal output from the sensor into digital data. In addition, the sensor I/F 114 may supply drive current to each sensor. In addition, the sensor I/F 114 may be provided with a circuit that acquires the output value of each sensor according to the sampling frequency specified by the main processor 111 and outputs the output value to the main processor 111.

A waste sheet remaining amount sensor 301, an additive remaining amount sensor 302, a sheet discharge sensor 303, a water amount sensor 304, an air volume sensor 306, an air velocity sensor 307, and a temperature sensor 309 are coupled to the sensor I/F 114.

The waste sheet remaining amount sensor 301 is a sensor that detects the remaining amount of the waste sheet (raw material) accumulated in each stacker 11 of the supply portion 10. The control device 110 can detect the presence or absence of the remaining amount of waste sheet accommodated in each stacker 11 based on the detection value of the waste sheet remaining amount sensor 301.

The additive remaining amount sensor 302 is a sensor that detects the remaining amount of the additive which can be supplied from the additive supply portion 52, and may be configured to be able to detect the remaining amount of the additive contained in each of the plurality of additive cartridges 501. The control device 110 can obtain the remaining amount of the additive in each additive cartridge 501, or can determine whether or not the remaining amount of the additive is a threshold value or greater, based on the detection value of the additive remaining amount sensor 302.

The discharge sensor 303 detects the amount of sheets S accumulated in the tray or stacker of the discharge portion 96. The control device 110 can perform notification when it is determined that the amount of the sheet S accumulated in the discharge portion 96 is the set value or greater, based on the detection value of the sheet discharge sensor 303, for example.

The water amount sensor 304 is a sensor that detects the water amount of a water supply tank (not illustrated) built in the sheet manufacturing apparatus 100. The control device 110 performs a notification when the water amount detected by the water amount sensor 304 lowers below the set value. In addition, the water amount sensor 304 may be configured to be able to detect the remaining amount of the tank (not illustrated) of a vaporization type humidifier 343 and/or a mist type humidifier 347.

The air volume sensor 306 detects the air volume of the air flowing inside the sheet manufacturing apparatus 100. In addition, the air velocity sensor 307 detects the air velocity of the air flowing inside the sheet manufacturing apparatus 100. The control device 110 can determine the state of the air flow (material transport air flow) inside the sheet manufacturing apparatus 100 based on the detection values of the air volume sensor 306 and the air velocity sensor 307. Based on the determination result, the control device 110 can appropriately maintain the state of the air flow inside the sheet manufacturing apparatus 100 by controlling the rotation speed of the defibrating portion blower 26, the mixing blower 56, and the like.

The temperature sensor 309 is a sensor that detects the temperature of the heating roller 86 provided in the heating portion 84. The control device 110 detects the temperature of the heating roller 86, that is, the heating temperature at which the second web W2 is heated by the heating roller 86, based on the detection value of the temperature sensor 309.

The control device 110 is coupled to each drive portion provided in the sheet manufacturing apparatus 100 via a drive portion I/F (interface) 115. A motor, a pump, a heater, and the like provided in the sheet manufacturing apparatus 100 are coupled to the drive portion I/F 115. Although these are generically called a drive portion, in particular, a portion that causes physical displacement, such as a motor, can be used as a drive portion, and another portion such as heater can also be referred to as an operation portion. In the following description, the drive portion includes a drive portion and an operation portion that are coupled to the drive portion I/F 115 and perform functions according to the control of the control device 110.

The drive portion I/F 115 may be coupled to each drive portion described above via a drive integrated circuit (IC). For example, the drive IC is a circuit that supplies a drive current to the drive portion according to the control of the main processor 111, and is configured to include a power semiconductor element or the like. For example, the drive IC may be an inverter circuit or a drive circuit for driving a stepping motor, and the specific configuration and specifications thereof may be appropriately selected in accordance with the coupled drive portion.

A coarse crushing portion drive motor 311 is coupled to the drive portion I/F 115, and rotates a cutting blade (not illustrated) that cuts the waste sheet, which is the raw material, in accordance with the control of the control device 110.

A defibrating portion drive motor 313 is coupled to the drive portion I/F 115 and rotates a rotor (not illustrated) provided in the defibrating portion 20 according to the control of the control device 110.

A sheet feeding motor 315 is attached to the supply portion 10, and supplies the waste sheet from one of the stackers 11 to the coarse crushing portion 12 according to the control of the control device 110. For example, the sheet feeding motors 315 are provided in each of the stackers 11 and selectively coupled to rollers (not illustrated) that feed the waste sheet from the stacker 11 to drive the rollers. Under the control of a control portion 150, the sheet feeding motor 315 engages with the roller of any stacker 11 and drives the roller to supply the waste sheet to the coarse crushing portion 12.

An additive supply motor 317 is coupled to the drive portion I/F 115, and drives a screw feeder (not illustrated) that feeds the additive in the supply adjustment portion 52*b* according to the control of the control device 110. The additive supply motor 317 may be a motor that opens and closes a shutter of the supply adjustment portion 52*b*.

The defibrating portion blower 26 is coupled to the drive portion I/F 115. Similarly, the mixing blower 56, the suction blower 77, the intermediate blower 318, and the collection blower 28 are coupled to the drive portion I/F 115 in the drive portion I/F 115. With this configuration, the control device 110 can control the start and stop of the defibrating portion blower 26, the mixing blower 56, the suction blower 77, the intermediate blower 318, and the collection blower 28. The intermediate blower 318 is a blower that performs suction from the suction mechanism 79*c* of the transport portion 79. The control device 110 may control start/stop of suction by each of these blowers, and may be configured to be able to control the number of rotation speed of each blower.

In addition, a drum drive motor 325, a belt drive motor 327, a dividing portion drive motor 329, a drum drive motor 331, a belt drive motor 333, the pressurizing portion drive motor 335, and the heating portion drive motor 337 are coupled to the drive portion I/F 115 includes The drum drive motor 325 is a motor that rotates the drum portion 41. The belt drive motor 327 is a motor that operates the mesh belt 46 of the first web forming portion 45. The dividing portion drive motor 329 is a motor that rotates the rotating body 49. The drum drive motor 331 is a motor that rotates the drum portion 61. The belt drive motor 333 is a motor that drives the mesh belt 72. In addition, the pressurizing portion drive motor 335 is a motor that drives the calender roller 85 of the pressurizing portion 82. The heating portion drive motor 337 is a motor that drives the heating roller 86 of the heating portion 84.

The control device 110 controls ON/OFF of each of these motors. In addition, the control device 110 may be configured to be able to control the number of rotation speed of each of the motors described above.

A heater 339 is a heater that heats the heating roller 86, and corresponds to the heat source H illustrated in FIG. 2. The heater 339 is coupled to the drive portion I/F 115, and the control device 110 controls ON/OFF of the heater 339. In addition, the heater 339 may be configured to be able to switch the output, and the control device 110 may be configured to be able to control the output of the heater 339.

The roller moving portion 341 operates the displacement mechanism 190 (FIGS. 4 and 5) provided in the heating portion 84 to displace the heating portion 84 to the first position of FIG. 4 and the second position of FIG. 5. The roller moving portion 341 is coupled to the control device 110 via the drive portion I/F 115, and the control device 110 controls the roller moving portion 341 to switch between the first position and the second position of the heating portion 84.

The vaporization type humidifier 343 is a device that is provided with a tank (not illustrated) storing water, and a filter (not illustrated) being infiltrated with the water of the tank, and blows and humidifies the filter. The vaporization type humidifier 343 includes a fan (not illustrated) coupled to the drive portion I/F 115, and turns ON/OFF air blowing to the filter according to the control of the control device 110. In the present embodiment, the humidified air is supplied from the vaporization type humidifier 343 to the humidifying portions 202, 204, 206, and 208. Therefore, the humidifying portions 202, 204, 206, and 208 supply the humidified air supplied by the vaporization type humidifier 343 to the coarse crushing portion 12, the sorting portion 40, the tube 54, and the accumulating portion 60. In addition, the vaporization type humidifier 343 may be configured to include a plurality of vaporization type humidifiers. In this case, the installation place of each vaporization type humidifier may be any of the coarse crushing portion 12, the sorting portion 40, the tube 54, and the accumulating portion 60.

In addition, the vaporization type humidifier 343 is provided with a humidifying heater 345 heating the air blown to a filter by a fan. The humidifying heater 345 is coupled to the drive portion I/F 115 separately from the fan (not illustrated) provided in the vaporization type humidifier 343. The control device 110 controls ON/OFF of the fan provided in the vaporization type humidifier 343 and controls ON/OFF of the humidifying heater 345 independently of the control of the vaporization type humidifier 343. The vaporization type humidifier 343 corresponds to a humidifier of the present invention, and the humidifying heater 345 corresponds to a heat source.

The mist type humidifier 347 is provided with a tank (not illustrated) storing water, and a vibration portion (not illustrated) vibrating the water of the tank to generate mist-like water droplets (mist). The mist type humidifier 347 is coupled to the drive portion I/F 115, and turns ON/OFF the vibration portion according to the control of the control portion 150. In the present embodiment, air containing mist is supplied from the mist type humidifier 347 to the humidifying portions 210 and 212. Therefore, the humidifying portions 210 and 212 supply air including mist supplied by the mist type humidifier 347 to each of the first web W1 and the second web W2.

A water supply pump 349 is a pump that sucks water from the outside of the sheet manufacturing apparatus 100 and takes water into a tank (not illustrated) provided inside the sheet manufacturing apparatus 100. For example, when the sheet manufacturing apparatus 100 is started, an operator operating the sheet manufacturing apparatus 100 puts water in a water supply tank and sets the water supply tank. The sheet manufacturing apparatus 100 operates the water supply pump 349 to take water from the water supply tank into the tank inside the sheet manufacturing apparatus 100. In addition, the water supply pump 349 may supply water from the tank of the sheet manufacturing apparatus 100 to the vaporization type humidifier 343 and the mist type humidifier 347.

A cutting portion drive motor 351 is a motor that drives the first cutting portion 92 and the second cutting portion 94 of the cutting portion 90. The cutting portion drive motor 351 is coupled to the drive portion I/F 115.

In addition, an IC reader 119 is coupled to the control device 110. The IC reader 119 reads data from an IC 521 provided in each of the additive cartridges 501 (FIG. 6) attached to the additive supply portion 52.

The IC 521 is attached to each of the additive cartridges 501. The IC 521 is an IC chip provided with a storage area for storing data, and stores data regarding the additive contained in the additive cartridge 501. The IC 521 may be a contact IC chip or a non-contact IC chip (for example, radio frequency identifier (RFID)). For example, the data stored in the IC 521 may include the color, properties, suitable heating temperature and the like of the additive contained in the additive cartridge 501, and may include a code corresponding to these data. In the present embodiment, the IC 521 stores at least temperature data (temperature information) indicating the heating temperature of the additive.

The IC reader 119 is a device that reads data stored in the IC 521, and can be a contact type or non-contact type IC reader/writer, for example. For example, a plurality of IC readers 119 may be installed corresponding to the number of additive cartridges 501 that can be attached to the additive supply portion 52. The IC reader 119 reads data from each of the plurality of ICs 521 attached to each additive cartridge 501 and outputs the read data to the control device 110 according to the control of the control device 110.

Figure 8:
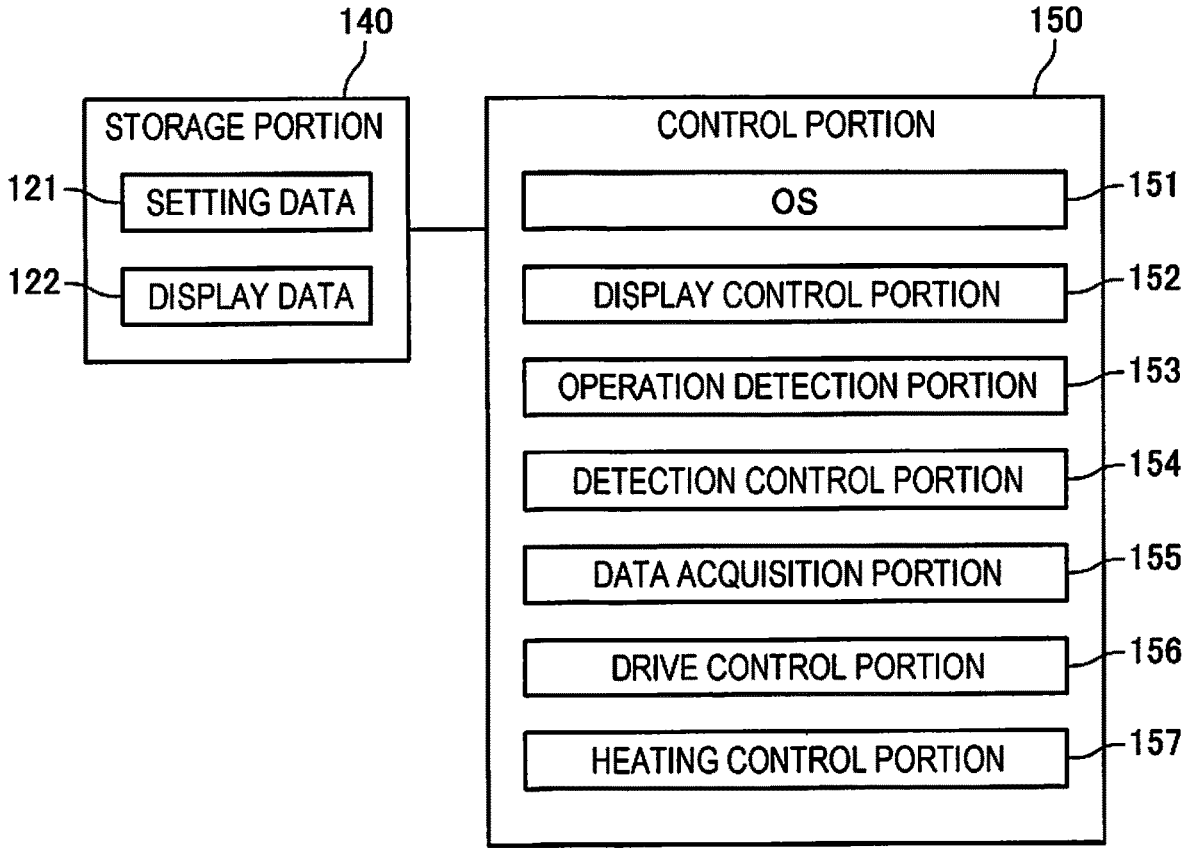
FIG. 8 is a block diagram illustrating a functional configuration of a control portion and a storage portion.

FIG. 8 is a functional block diagram of the sheet manufacturing apparatus 100, illustrating a functional configuration of a storage portion 140 and a control portion 150. The storage portion 140 is a logical storage portion configured to include the non-volatile storage portion 120 (FIG. 7).

The control portion 150 and various functional portions included in the control portion 150 are formed by the cooperation of software and hardware when the main processor 111 executes a program. Examples of hardware that configures these functional portions include the main processor 111 and the non-volatile storage portion 120.

The storage portion 140 stores the setting data 121 and the display data 122 described above.

The control portion 150 has functions of an operating system (OS) 151, a display control portion 152, an operation detection portion 153, a detection control portion 154, a data acquisition portion 155, a drive control portion 156, and a heating control portion 157.

The function of the operating system 151 is a function of a control program stored in the storage portion 140, and each part of the control portion 150 is a function of an application program executed on the operating system 151.

The display control portion 152 causes the display panel 116 to display an image based on the display data 122.

The operation detection portion 153 determines the content of the GUI operation corresponding to the detected operation position when the operation on the touch sensor 117 is detected.

The detection control portion 154 acquires detection values of various sensors coupled to the sensor I/F 114. In addition, the detection control portion 154 determines the detection value of the sensor coupled to the sensor I/F 114 in comparison with a preset threshold value (setting value). When the determination result corresponds to the condition for performing notification, the detection control portion 154 outputs the notification content to the display control portion 152, and causes the display control portion 152 to perform notification using an image or text.

The data acquisition portion 155 causes the IC reader 119 to read data from the IC 521.

The drive control portion 156 controls start (activation) and stop of each drive portion coupled via the drive portion I/F 115. In addition, the drive control portion 156 may be configured to control the rotation speed of the defibrating portion blower 26, the mixing blower 56, and the like.

The heating control portion 157 controls the temperature at which the second web W2 is heated by the heating roller 86 of the heating portion 84. The heating control portion 157 sets the heating temperature by the heating portion 84. Here, the temperature set by the heating control portion 157 can be referred to as a target temperature to be a target of control. The heating control portion 157 acquires the detection value of the temperature sensor 309 and controls the heater 339 so that the heating temperature of the heating portion 84 is the set target temperature.

The accuracy of the temperature control performed by the heating control portion 157 may be set to a level that can satisfy the quality of the sheet S. Specifically, the heating control portion 157 maintains the temperature of the heating roller 86 within a predetermined temperature range including the set target temperature by switching ON/OFF the heater 339 and/or controlling the output of the heater 339. The magnitude of the predetermined temperature range and the difference from the target temperature are appropriately set. For example, the setting method and conditions of the predetermined temperature range with respect to the target temperature may be included in the setting data 121 and stored in the storage portion 140, and the heating control portion 157 may perform control according to the setting. In addition, the heating control portion 157 may control ON/OFF of the humidifying heater 345.

5. Operation of Sheet Manufacturing Apparatus

Subsequently, the operation of the sheet manufacturing apparatus 100 will be described.

Figure 9:
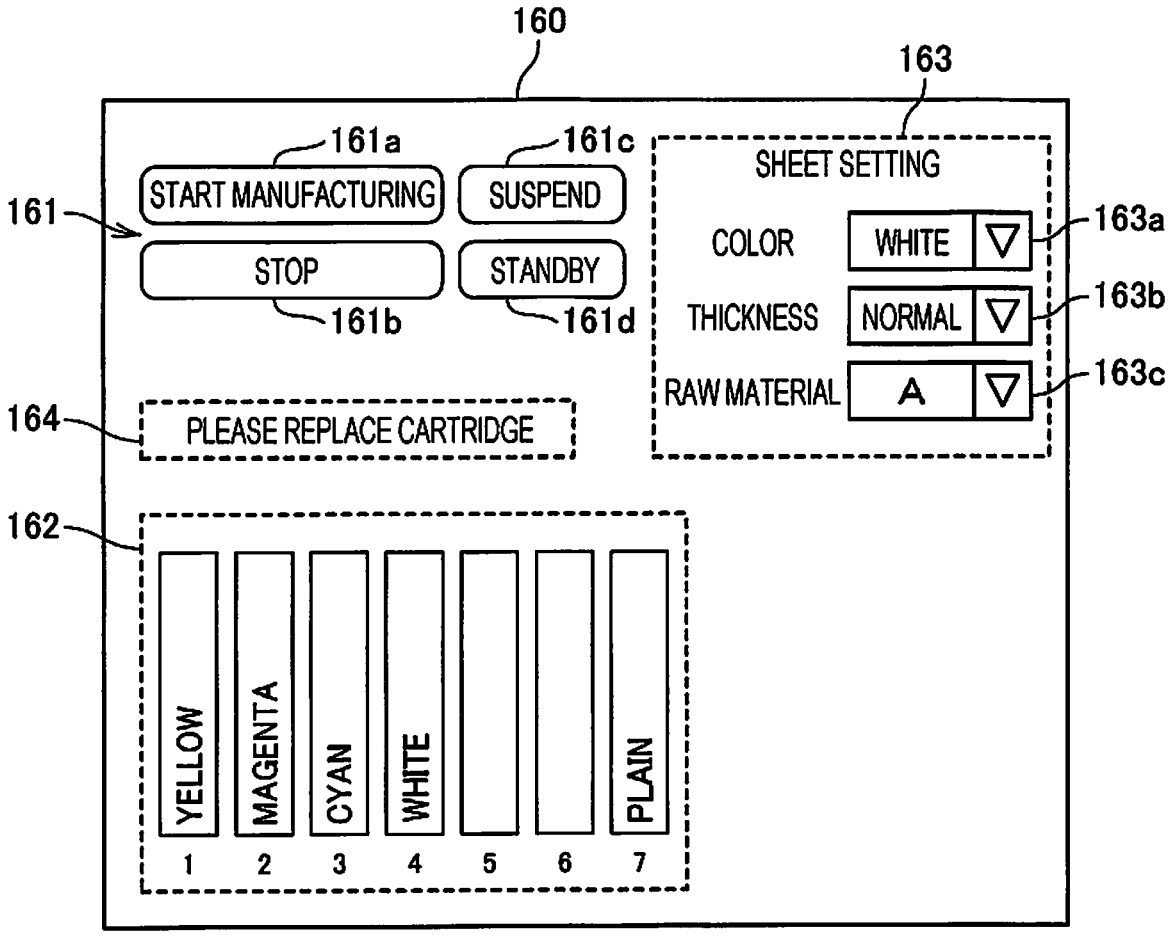
FIG. 9 is a diagram illustrating an example of a display screen.

FIG. 9 is a diagram illustrating an example of a screen displayed by the display panel 116, and illustrates an operation screen 160 for a user (operator) operating the sheet manufacturing apparatus 100 to operate.

The operation screen 160 of FIG. 9 may be displayed by the display panel 116 after the sheet manufacturing apparatus 100 is powered on, and may be continuously displayed while the sheet manufacturing apparatus 100 manufactures the sheet S or in a standby state described later.

On the operation screen 160, an operation instruction portion 161, a cartridge information display portion 162, a sheet setting portion 163, and a notification portion 164 are disposed. The operation instruction portion 161 and the sheet setting portion 163 constitute a GUI for the user to operate. By displaying the operation screen 160 on the display panel 116, the touch sensor 117 and the operation detection portion 153 (FIG. 8) constitute a reception portion.

The operation instruction portion 161 includes a start instruction button 161*a*, a stop instruction button 161*b*, an suspend instruction button 161*c*, and a standby instruction button 161*d*, which function as buttons (operation portions) for instructing the operation of the sheet manufacturing apparatus 100.

The sheet setting portion 163 includes a color setting portion 163*a*, a thickness setting portion 163*b*, and a raw material setting portion 163*c*, which function as buttons (operation portions) for instructing the conditions of the sheet S manufactured by the sheet manufacturing apparatus 100.

Each operation portion disposed in the operation instruction portion 161 and the sheet setting portion 163 may be installed in the casing of the sheet manufacturing apparatus 100 as a physical button. In the present embodiment, as an example, an example in which the above-described operation portions are provided as a GUI (icon) by the display panel 116 and the touch sensor 117 will be described.

The color setting portion 163*a* is an operation portion for specifying the color of the sheet S. In the example of FIG. 9, when the user operates the color setting portion 163*a*, the color of the sheet S can be selected from a plurality of colors set in advance by the pull-down menu. The control portion 150 causes the operation detection portion 153 to acquire the color selected by the operation of the color setting portion 163*a*. The drive control portion 156 determines the type of additive to be used and the ratio of each additive when using a plurality of types of the additives among the additives of the additive cartridge 501 attached to the additive supply portion 52 corresponding to the selected color. The drive control portion 156 determines the amount of additive supplied from each of the additive cartridges 501 based on the type of additive to be used and the ratio of each additive when using the plurality of types of the additives, and controls the additive supply motor 317 based on the determined amount.

The thickness setting portion 163*b* is an operation portion for specifying the thickness of the sheet S. In the example of FIG. 9, when the user operates the thickness setting portion 163*b*, the thickness of the sheet S can be selected from the thickness of a plurality of levels set in advance by the pull-down menu. The control portion 150 causes the operation detection portion 153 to acquire the thickness selected by the operation of the thickness setting portion 163*b*. The drive control portion 156 determines the conditions such as the thickness of the second web W2 accumulated on the mesh belt 72 in the accumulating portion 60 and/or the load applied to the second web W2 by the pressurizing portion 82 corresponding to the selected thickness. The drive control portion 156 controls the rotational speed of the drum drive motor 331, the rotational speed of the belt drive motor 333, an operation condition of the pressurizing portion drive motor 335, and the like corresponding to the determined condition.

The raw material setting portion 163*c* is an operation portion for specifying the raw material used for manufacturing the sheet S. In the example of FIG. 9, when the user operates the raw material setting portion 163*c*, the type of the raw material can be selected from a plurality of types set in advance by the pull-down menu. The raw material that can be selected by the raw material setting portion 163*c* is a raw material that the supply portion 10 accommodates in the stacker 11. That is, the selection in the raw material setting portion 163*c* corresponds to the selection of the stacker 11 that feeds the raw material in the supply portion 10. The control portion 150 causes the operation detection portion 153 to acquire the raw material selected by the operation of the raw material setting portion 163*c*. The drive control portion 156 selects the stacker 11 that accommodates the selected raw material, and controls the sheet feeding motor 315 so that the raw material is supplied from the selected stacker 11.

In addition, in the sheet setting portion 163, in addition to the above-described buttons, a button for specifying the number of sheets S to be manufactured or a button for specifying the size (dimension) of the sheet S may be disposed, and a button for specifying a condition related to the other sheet S may be disposed.

The start instruction button 161*a* is a button for instructing the start of the manufacture of the sheet S. For example, the start instruction button 161*a* is operated after the condition related to the sheet S is specified by the operation of the sheet setting portion 163, and instructs start of the manufacture of the sheet S based on the specified condition. In the sheet setting portion 163, when a default specified value is provided in advance, and the start instruction button 161*a* is operated in a state where the sheet setting portion 163 is not operated, the sheet manufacturing apparatus 100 may start the manufacture of the sheet S based on the default specified value.

The stop instruction button 161*b* is a button for instructing stop of the operation of the sheet manufacturing apparatus 100. The casing of the sheet manufacturing apparatus 100 may be provided with a power switch (not illustrated) for turning ON/OFF the power of the sheet manufacturing apparatus 100 separately from the display panel 116. In this case, the stop instruction button 161*b* functions as a button for instructing to stop the sheet manufacturing apparatus 100. However, the stop instruction button 161*b* may be configured to be capable of instructing to turn off the sheet manufacturing apparatus 100. When the sheet manufacturing apparatus 100 stops the manufacture of the sheet S by the operation of the stop instruction button 161*b*, the condition related to the sheet S set by the sheet setting portion 163 is cleared and returns to the default specified value (initial value).

The suspend instruction button 161*c* temporarily suspends the manufacture of the sheet S while the sheet manufacturing apparatus 100 performs the manufacture of the sheet S. When the suspend instruction button 161*c* is operated and the sheet manufacturing apparatus 100 stops the manufacture of the sheet S, the condition related to the sheet S set by the sheet setting portion 163 is maintained. In this state, when the start instruction button 161*a* is operated, the control portion 150 starts (resumes) the manufacture of the sheet S in accordance with the same conditions as those before the suspend instruction button 161*c* is operated by the sheet manufacturing apparatus 100.

The standby instruction button 161*d* is a button for instructing transition to the standby state described later in a state where the sheet manufacturing apparatus 100 is not manufacturing the sheet S, that is, in a stopped state.

A series of operations for manufacturing the sheet S by the sheet manufacturing apparatus 100 will be referred to as "job". The job refers to an operation of manufacturing the sheet S under the condition specified by the operation of the sheet setting portion 163 or the default value. Specifically, the operation from the start of the operation in response to the operation to complete the manufacture of the number of sheets S specified by the operation of the sheet setting portion 163, or to the operation of the start instruction button 161*a* to the stop by the operation of the stop instruction button 161*b* is called the job. When the number of sheets S to be manufactured is specified, the end of the job is clearly specified. When the stop instruction button 161*b* is operated without specifying the number of sheets S, or when the stop instruction button 161*b* is operated before completing the manufacture of the specified number of sheets S, there is no prior setting, but the job ends. When the suspend instruction button 161*c* is operated, the sheet manufacturing apparatus 100 suspends the job, but does not end the job. Therefore, when the manufacture of the sheet S is stopped in response to the operation of the suspend instruction button 161*c*, and the start instruction button 161*a* is operated, the sheet manufacturing apparatus 100 resumes the manufacture of the sheet S, and specifically, manufactures the sheet S under the same conditions as before the operation of the suspend instruction button 161*c*. That is, the suspend instruction button 161*c* temporarily suspends the job, and thereafter, when the start instruction button 161*a* is operated, the job continues.

The cartridge information display portion 162 is a display portion that displays information on the additive cartridge 501 attached (set) to the additive supply portion 52. On the cartridge information display portion 162, an image imitating the additive cartridge 501 is displayed corresponding to the number of the additive cartridges 501 that can be attached to the additive supply portion 52. On the cartridge information display portion 162, information indicating the color of the additive and the remaining amount of the additive accommodated in the additive cartridge 501 is displayed by text or image corresponding to the image of each of the additive cartridges 501. In addition, when the number of the additive cartridges 501 attached to the additive supply portion 52 is smaller than the attachable number, the image corresponding to the additive cartridge 501 not attached is displayed blank.

The notification portion 164 is a display area where the content to be notified to the user is displayed by text or an image. For example, the notification portion 164 displays a message for requesting replacement of the additive cartridge 501.

FIG. 10 is a table illustrating an example of the operation state of the sheet manufacturing apparatus 100.

In the drawing, the supply portion refers to the supply portion 10, and refers to the state of the sheet feeding motor 315, for example. The coarse crushing portion refers to the coarse crushing portion 12, and refers to the state of the coarse crushing portion drive motor 311 for example. Although the defibrating portion refers to the defibrating portion 20, and specifically refers to the state of the defibrating portion drive motor 313, the defibrating portion may be in the operation state of the defibrating portion 20 including the state of the defibrating portion blower 26. The sorting portion refers to the sorting portion 40, and specifically refers to the state of the drum drive motor. Although the first web forming portion refers to the first web forming portion 45, and specifically refers to the state of the belt drive motor 327, and the first web forming portion may be in the operation state of the first web forming portion 45 including the state of the collection blower 28. The rotating body refers to the rotational state of the dividing portion drive motor 329 that drives the rotating body 49.

The mixing portion refers to the state of the mixing portion 50, and specifically refers to the operation state of the additive supply motor 317 that drives the additive supply portion 52 and the mixing blower 56. The accumulating portion refers to the accumulating portion 60, and specifically, refers to the operation state of the drum drive motor 331 that moves the drum portion 61. Although the second web forming portion refers to the second web forming portion 70, and specifically refers to the operation state of the belt drive motor 333, the second web forming portion may be in the operation state of the second web forming portion 70 including the state of the suction blower 77. Although the pressurizing portion indicates the pressurizing portion 82, and specifically, the operation state of the pressurizing portion drive motor 335, the pressurizing portion may include the state of the load by the pressurizing portion 82. The heating portion refers to the heating portion 84, and specifically refers to the operation state of the heating portion drive motor 337 and the state of the heater 339, respectively. In addition, although the cutting portion refers to the cutting portion 90, and specifically, the operation state of the cutting portion drive motor 351, the cutting portion may include the operation state of the transport portion (not illustrated) transporting the sheet S in the cutting portion 90. The discharge portion refers to the operation state of the transport portion (not illustrated) transporting the sheet S to the discharge portion 96. In addition, the humidifying heater refers to the state of the humidifying heater 345.

In addition, FIG. 10 is not limited to an energized state of each of the drive portions, and indicates the state of control in which the control portion 150 drives each part. For example, ON/OFF of the heating of the heating portion 84 does not indicate ON/OFF of energization of the heater 339, and indicates whether or not the control portion 150 performs control for heating by the heater 339. Therefore, even when there is an instant when the heater 339 is not energized, the operation state is ON while the control portion 150 performs control for heating by the heater 339. The same applies to the other drive portions.

There are three operation states of the sheet manufacturing apparatus 100 according to the present embodiment: a first state, a second state, and a third state. The first state is a state where the sheet manufacturing apparatus 100 manufactures the sheet S, and corresponds to an operation state. In addition, the first state can also be called a normal state. In the first state, as illustrated in FIG. 10, each part of the sheet manufacturing apparatus 100 is ON and driven.

On the other hand, the second state (suspended state) corresponds to the above-described standby state, and is performed under the control of the control portion 150 described later. The control portion 150 causes the sheet manufacturing apparatus 100 to shift from the first state to the second state when the standby instruction button 161*d* on the operation screen 160 (FIG. 9) is operated or by control described later, for example. In the second state, at least the drive portion related to the transport of the raw material, the material, and the sheet S is turned off. In addition, in the second state, at least the heater 339 is turned on, and more preferably the humidifying heater 345 is turned on. The raw material refers to the waste sheet accommodated in the stacker 11, and the material includes the defibrated material defibrated by the defibrating portion 20, the first web W1, the subdivided body P, the mixture mixed by the mixing portion 50, and the second web W2.

In the stopped state, as illustrated in FIG. 10, each drive portion coupled to the drive portion I/F 115 is turned off.

FIG. 11 is a table illustrating an example of data read from the IC by the IC reader 119, and in particular, illustrates an example of temperature data of the additive. In the example illustrated in FIG. 11, the additive cartridge 501 is distinguished by the color of the additive contained in the additive cartridge 501. In this example, temperature data "Th11" is acquired from the IC 521 of the additive cartridge 501 of yellow (YELLOW in the drawing). In addition, "Th12" is acquired from the IC 521 of the additive cartridge 501 of MAGENTA, and "Th13" is acquired from the IC 521 of the additive cartridge 501 of CYAN. In addition, "Th14" is acquired from the IC 521 of the additive cartridge 501 of WHITE, and "Th15" is acquired from the IC 521 of the additive cartridge 501 of PLAIN. Th11, Th12, Th13, Th14, and Th15 are numerical values or codes indicating the specific temperature or the range of the temperature, respectively. These temperatures are the temperature set at the heating portion 84 so as to melt the resin contained in each of the additives in an appropriate state, adhere the fibers with a desired strength, and obtain good color development. When manufacturing the sheet S, the control portion 150 specifies the additive used for manufacturing the sheet S, and thereafter sets the heating temperature of 84 of the heating portion based on the temperature data read from the IC 521 of the additive cartridge 501 containing the specified additive. As a result, the second web W2 can be heated at an appropriate temperature in the heating portion 84, and a high quality sheet S can be manufactured. Although the specific temperature of Th11 to Th15 varies depending on the specific properties of the additive, since there is practically no melting of the additive at temperatures close to room temperature, the specific temperature is higher than the so-called room temperature. For example, temperatures exceeding 100 degrees Celsius are not uncommon.

When the manufacture of the sheet S is started from the state where the manufacture of the sheet S is not started, for example, from the stopped state illustrated in FIG. 10, it takes time to bring the sheet manufacturing apparatus 100 into a state in which each of the drive portions can manufacture the sheet S. For example, as illustrated in FIG. 11, it is necessary to set the heating temperature of the heating portion 84 to an appropriate temperature in accordance with the additive contained in the additive cartridge 501. In the stopped state, the temperature of the heating roller 86 is affected by an ambient temperature of the sheet manufacturing apparatus 100, so that the temperature is close to the ambient temperature in many cases. From such a temperature, it takes time to raise the temperature of the heating roller 86 to Th11 to Th15 illustrated in FIG. 11. In order to rapidly and continuously manufacture the sheet S and maintain the quality of the manufactured sheet S, it is preferable that the heat capacity of the heating roller 86 be larger, and as the heat capacity of the heating roller 86 is larger, it takes more time to raise the temperature. Although it is possible to rapidly raise the temperature by increasing a calorific value of the heater 339, also in such a case, it is not easy to raise the temperature in a significantly short time. In addition, when the heater 339 has a characteristic that the amount of calorific value is large and the temperature rises rapidly, it may be difficult to control the temperature of the heating roller 86 with high accuracy, and the power consumption of the sheet manufacturing apparatus 100 may be increased. Therefore, it is not easy to reduce the waiting time from the stopped state of the sheet manufacturing apparatus 100 to the start of the manufacture of the sheet S.

In the sheet manufacturing apparatus 100, the second state can be performed as the operation state. Since the heater 339 can be maintained ON in this second state, the temperature of the heating roller 86 can be maintained higher than the ambient temperature, for example. Therefore, when the manufacture of the sheet S is started from the second state, the manufacture of the sheet S can be performed in a shorter time, as compared with when the manufacture of the sheet S is started from the stopped state, and the waiting time can be reduced.

Figure 12:
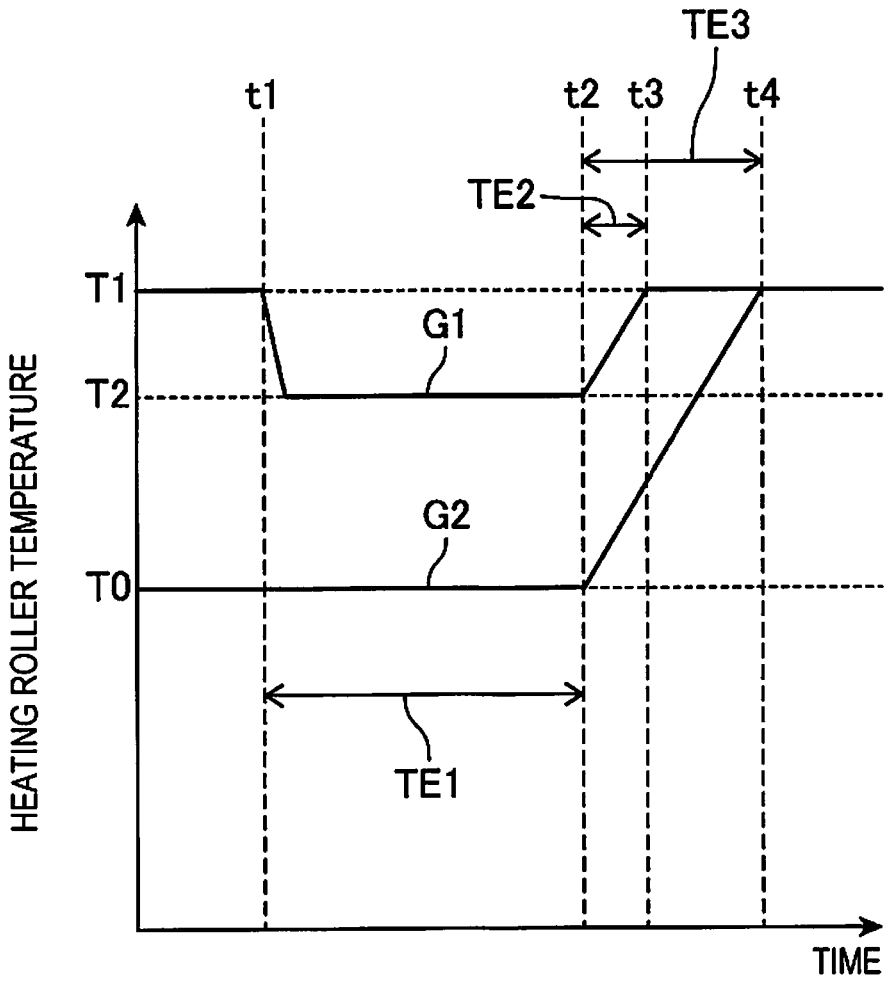
FIG. 12 is a timing chart illustrating an operation example of the sheet manufacturing apparatus of the first embodiment.

FIG. 12 is a timing chart illustrating an operation example of the sheet manufacturing apparatus 100, and in particular, illustrates a change in temperature of the heating roller 86. A vertical axis in FIG. 12 illustrates the temperature of the heating roller 86. For example, this temperature is a temperature detected by the temperature sensor 309. A horizontal axis illustrates the passage of time.

The temperature T1 in the vertical axis is a temperature suitable for manufacturing the sheet S, and is a target temperature set by the heating control portion 157 in accordance with the conditions of the sheet S to be manufactured. The temperature T2 is a temperature set by the heating control portion 157 as the target temperature for maintaining the temperature of the heating roller 86 in the second state.

On the other hand, T0 is the ambient temperature of the place where the sheet manufacturing apparatus 100 is installed.

In the timing chart of FIG. 12, a temperature pattern G1 illustrates the temperature change of the heating roller 86 when the sheet manufacturing apparatus 100 shifts from the first state to the second state and thereafter shifts to the first state. In the first state, an example is illustrated in which the control portion 150 starts a transition to the second state at time t1 and thereafter starts a transition to the first state at time t2. For example, time t1 is a timing when the suspend instruction button 161*c* is operated, and, for example, time t2 is a timing when the start instruction button 161*a* is operated. That is, a period TE1 from time t1 to time t2 is a time when the second state is continued. On the other hand, a temperature pattern G2 illustrates an example when the transition to the first state is started at time t2 in the stopped state.

As illustrated in the temperature pattern G1, the temperature of the heating roller 86 is maintained at T1 in the first state, and decreases when the transition to the second state is started at time t1. The heating control portion 157 maintains the temperature of the heating roller 86 at T2 in the second state. When the transition to the first state is started at time t2, the temperature rise of the heating roller 86 is started. At a timing (time t3) when the temperature of the heating roller 86 reaches T1, the drive control portion 156 causes the operation of the drive portion related to the transport of the raw material, the material, and the sheet S to start the sheet manufacturing apparatus 100 to be in the first state, and the manufacture of the sheet S is started. Therefore, the waiting time from the start or restart of the manufacture of the sheet S to the start of the manufacture of the sheet S corresponds to the period TE2 from time t2 to time t3.

On the other hand, in the temperature pattern G2, since it is in the stopped state until time t2, the temperature of the heating roller 86 is close to the ambient temperature T0. In FIG. 12, the temperature of the heating roller 86 is illustrated as T0. When the transition to the first state is started at time t2, the temperature rise of the heating roller 86 is started. Here, in the temperature patterns G1 and G2, since the configuration of the heating portion 84 including the heater 339 is common to each other, a pattern of the temperature rise, that is, an inclination of the temperature rise is substantially the same as each other. Therefore, in the temperature pattern G2, the temperature of the heating roller 86 rises at the same inclination as that between time t2 and t3 of the temperature pattern G1. Therefore, the temperature of the heating roller 86 reaches the target temperature T1 at time t4 after time t3. In this case, the waiting time taken to start the manufacture of the sheet S after the start or restart of the manufacture of the sheet S is instructed corresponds to a period TE3 from time t2 to time t4.

As described above, the sheet manufacturing apparatus 100 can perform the first state where each drive portion coupled to the drive portion I/F 115 operates under the control of the control portion 150 and the second state in addition to the stopped state where each drive portion is stopped. In the second state, the operation state of a portion of the sheet manufacturing apparatus 100, for example, the heater 339 and the humidifying heater 345 is maintained ON. Therefore, when the manufacture of the sheet S is subsequently started, there is an advantage that the waiting time actually taken to start the transport of the raw material, the material, and the sheet S to start the manufacture can be reduced.

In the second state, by maintaining the humidifying heater 345 ON, the temperature of the vaporization type humidifier 343 can be maintained higher than the air temperature (ambient temperature) of the installation place of the sheet manufacturing apparatus 100. The change of the temperature of the humidifying heater 345 is the same as that of FIG. 12. Therefore, when the manufacture of the sheet S is not started until the temperature of the vaporization type humidifier 343 rises to a preferable temperature, similar to the contents described for the heater 339, the waiting time taken to start the manufacture of the sheet S can be reduced.

In addition, the drive control portion 156 displaces the heating portion 84 from the second position to the first position when shifting from the second state to the first state as described later. Specifically, at the timing when the sheet manufacturing apparatus 100 shifts to the second state (time t2 in FIG. 12), the heating portion 84 moves to the second position, and a pair of heating rollers 86 are separated from each other. At the timing when the temperature of the heating roller 86 reaches the target temperature T1 (time t3 in FIG. 12), the drive control portion 156 displaces the heating portion 84 to the first position.

It is known that a decrease in temperature occurs when a pair of heating rollers 86 is nipped and in contact with the second web W2. For example, a factor of the decrease in temperature is that the heat is absorbed by the second web W2 by the heating roller 86 coming into contact with the second web W2. Therefore, in the process of raising the temperature of the heating roller 86 by the heater 339 in the second state, the heating control portion 157 may raise the temperature of the heating roller 86 to a temperature higher than the target temperature T1. More specifically, when shifting from the second state to the first state, the heating control portion 157 sets the target temperature to a temperature T1' higher than the temperature T1 to be obtained from the IC 521 of the additive cartridge 501 and to be set to the target temperature as the target temperature. The drive control portion 156 displaces the heating portion 84 to the first position and the heating control portion 157 sets the target temperature to the temperature T1 corresponding to the condition (manufacturing condition) of the sheet S, at the timing when the temperature of the heating roller 86 reaches the target temperature T1'. The temperature T1' can be obtained by adding a temperature difference ΔT set in advance to the temperature T1 after the temperature T1 is determined. The temperature difference ΔT is determined in consideration of the temperature decrease due to the nip, and may be stored, for example, in the setting data 121 in advance.

As a result, even when the sheet manufacturing apparatus 100 is shifted to the first state at the timing when the heating portion 84 is displaced to the first position and the manufacture of the sheet S is rapidly started, the second web W2 can be reliably heated in the heating portion 84, immediately after the start of manufacture. Therefore, the amount of the sheet S which is defective in heating can be reduced.

Similarly, even when the manufacture of the sheet S is started from the stopped state, the heating control portion 157 temporarily sets a temperature higher than the target temperature corresponding to the condition related to the sheet S until the sheet manufacturing apparatus 100 shifts to the first state, and thus the same effect can be obtained.

Figure 13:
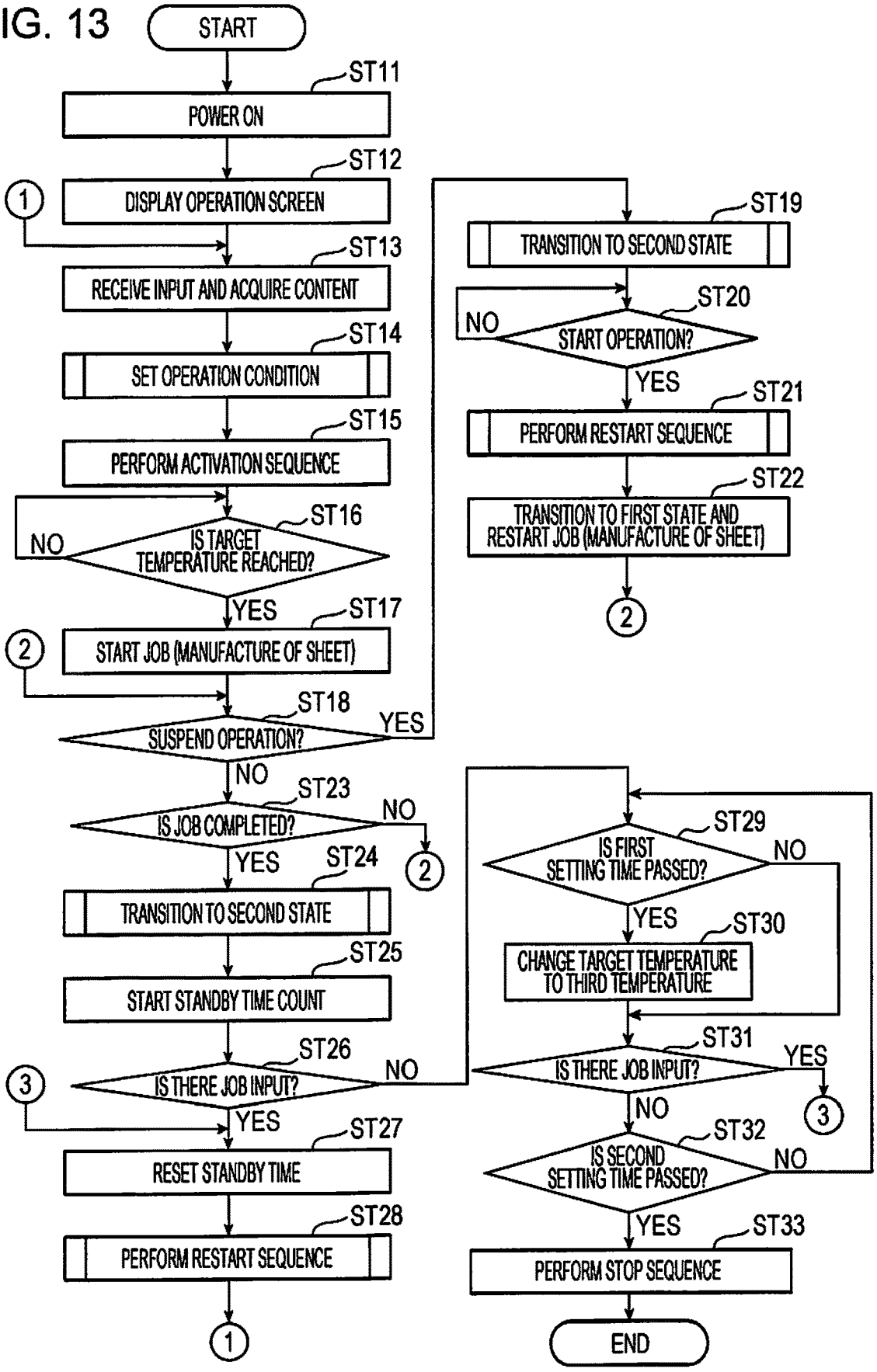
FIG. 13 is a flowchart illustrating an operation of the sheet manufacturing apparatus of the first embodiment.
Figure 14:
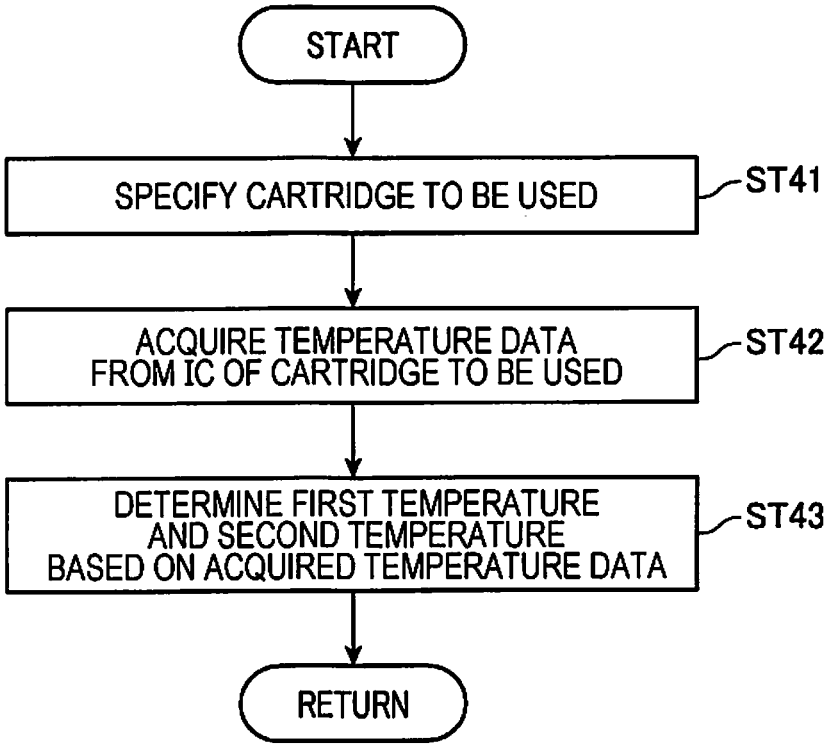
FIG. 14 is a flowchart illustrating an operation of the sheet manufacturing apparatus of the first embodiment.
Figure 15:
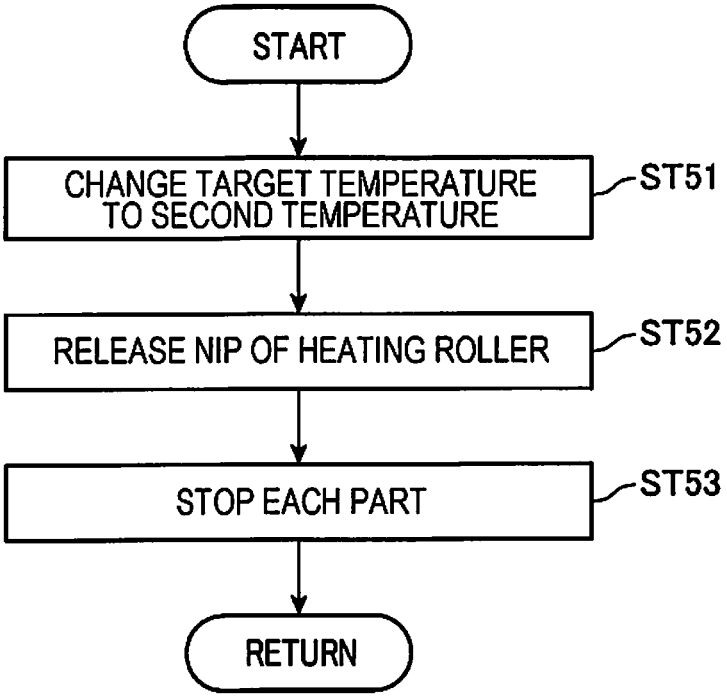
FIG. 15 is a flowchart illustrating an operation of the sheet manufacturing apparatus of the first embodiment.
Figure 16:
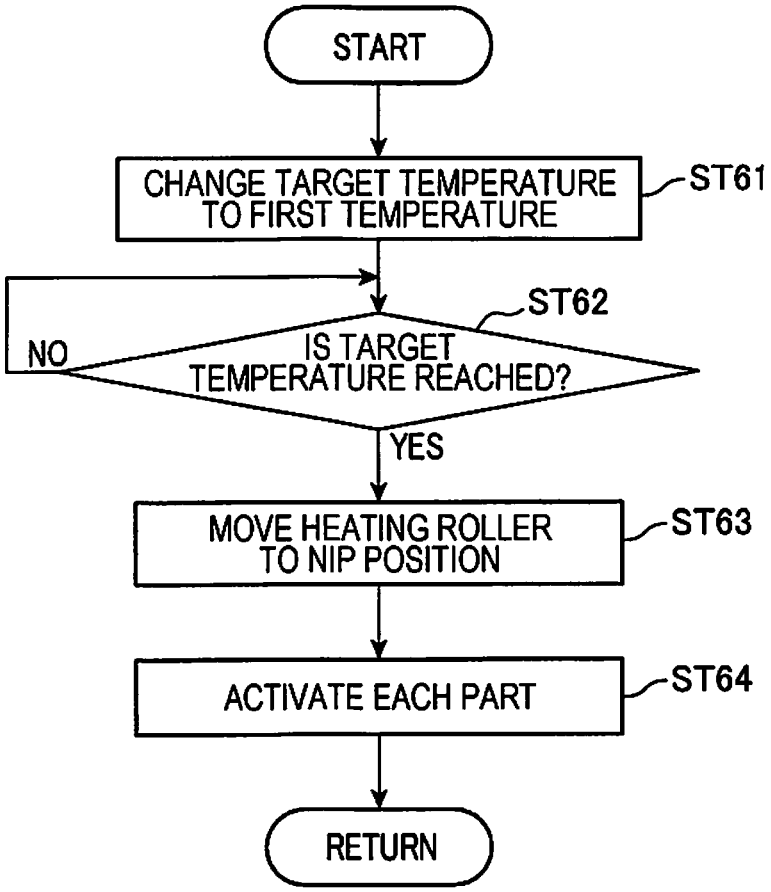
FIG. 16 is a flowchart illustrating an operation of the sheet manufacturing apparatus of the first embodiment.

FIG. 13 is a flowchart illustrating the operation of the sheet manufacturing apparatus 100. FIGS. 14, 15, and 16 are flowcharts illustrating the operation of the sheet manufacturing apparatus 100, and in particular, illustrate the treatment of FIG. 13 in detail.

When the sheet manufacturing apparatus 100 is powered on (Step ST11), the display control portion 152 causes the display panel 116 to display the operation screen 160 (Step ST12). The operation detection portion 153 detects an operation on the operation screen 160 by the user, performs a treatment of receiving an input by this operation, and acquires an operation content (Step ST13).

The control portion 150 sets the operation condition of the sheet manufacturing apparatus 100 based on the operation content acquired by the operation detection portion 153 in Step ST13 by the functions of the drive control portion 156 and the heating control portion 157 (Step ST14).

The treatment performed in Step ST14 is illustrated in detail in FIG. 14.

The control portion 150 specifies the additive cartridge 501 to be used among the additive cartridges 501 attached to the additive supply portion 52 based on the operation content acquired in Step ST13 (Step ST41). For example, based on the color specified by the operation of the color setting portion 163*a* of the sheet setting portion 163 or the type of the raw material specified by the operation of the raw material setting portion 163*c*, the type (for example, color) of the additive to be used is specified, and the additive cartridge 501 containing the specified type of additive is specified. Furthermore, the control portion 150 obtains the amount of additive per unit time supplied from the specified additive cartridge 501, and sets the conditions for operating the additive supply motor 317.

The control portion 150 acquires temperature data read by the IC reader 119 from the IC 521 attached to the additive cartridge 501 specified in Step ST41 (Step ST42). The control portion 150 detects the presence or absence of the IC 521 by the IC reader 119 when the additive cartridge 501 is attached or when the sheet manufacturing apparatus 100 is powered on, and reads data from the detected IC 521. The control portion 150 temporarily stores the read data in the storage portion 140 (or RAM 113) or the like corresponding to identification information identifying the IC 521. The identification information of the IC 521 is, for example, an ID unique to the IC 521, is information stored in a storage area of the IC 521, and can be read by the IC reader 119 with various data such as temperature data. In step ST42, the control portion 150 acquires temperature data corresponding to the additive cartridge 501 specified in step ST41 from the temporarily stored data. In addition, the control portion 150 may acquire the temperature data by reading data from the IC 521 by the IC reader 119 in Step ST42.

The control portion 150 determines the first temperature and the second temperature based on the temperature data acquired in Step ST42 (Step ST43). The first temperature is a target temperature of the heating roller 86 in the first state for manufacturing the sheet S, and corresponds to the temperature T1 illustrated in FIG. 12, for example. The second temperature is a target temperature of the heating roller 86 maintained in the second state, and corresponds to the temperature T2 illustrated in FIG. 12, for example. The control portion 150 temporarily stores the first temperature and the second temperature on the storage portion 140 (or RAM 113) or the like.

In Step ST43, when using a plurality of types of the additives, the control portion 150 acquires temperature data corresponding to each of the additives, and determines the first temperature based on the acquired plurality of temperature data. For example, the control portion 150 determines the highest temperature among the plurality of acquired temperature data as the first temperature.

As an example, in the temperature data of each additive illustrated in FIG. 11, the case where the relation illustrated in the following formula (1) is established is assumed.

$$Th11<Th12<Th13<Th14<Th15 \quad (1)$$

For example, when it is specified that the yellow additive and the cyan additive are used in Step ST41, the control portion 150 acquires temperature data Th11 and temperature data Th13 in Step ST42. In step ST43, the control portion 150 determines the first temperature based on the temperature data Th13 indicating the higher temperature among the temperature data Th11 and the temperature data Th13. In this method, when using the plurality of types of the additives, heating is performed according to the additives that require heating at a higher temperature, so that all the additives are heated above the required temperature. Therefore, it is possible to prevent the deterioration of the quality of the sheet S due to the insufficient heating.

In addition, the control portion 150 may determine the first temperature based on a plurality of pieces of temperature data reflecting the ratio of usage of the plurality of types of the additives to be used.

In Step ST43, although an example in which the first temperature is determined based on temperature data read from the IC 521 of the additive cartridge 501 containing the additive to be used is described, the first temperature corresponding to the raw material specified by the raw material setting portion 163*c* may be set. For example, the heating temperature of the heating portion 84 suitable for the raw material may be included in the setting data 121 and stored in advance, for each type of the raw material. In this case, the control portion 150 acquires, from the setting data 121, the heating temperature corresponding to the raw material specified by the raw material setting portion 163*c*. The control portion 150 may set the temperature on the higher side of the highest temperature among the temperature data corresponding to the additive to be used, and the heating temperature corresponding to the raw material to the first temperature.

In addition, the second temperature T2 is a temperature lower than the first temperature T1. For example, a temperature lower by a predetermined temperature difference (for example, 10° C.) than the lowest temperature Th11 among the first temperatures Th11 to Th15 is set as the second temperature T2. For example, the temperature difference or the second temperature is included in the setting data 121 and stored in the storage portion 140.

Returning to FIG. 13, the control portion 150 performs an activation sequence (Step ST15). In the activation sequence, the control portion 150 performs a treatment for initializing various sensors coupled to the sensor I/F 114 and starting detection. In addition, the activation sequence includes initialization of the operation of each drive portion coupled to the drive portion I/F 115 and control for shifting each drive portion to a state where the manufacture of the sheet S can be started. In this activation sequence, the control portion 150 turns on the power of the heater 339 to start the temperature rise. In addition, the control portion 150 turns on the power of the humidifying heater 345 to start the temperature rise.

The control portion 150 determines whether or not the temperature of the heater 339 is reached the first temperature set in Step ST14 (Step ST15), and stands by while the first temperature is not reached (Step ST15; No). As a matter of course, in the standby mode, the control portion 150 can control other drive portions. In addition, in step ST15, which corresponds to the case where the temperature of the heater 339 is raised from the stopped state, a temperature obtained by adding the temperature difference ΔT to the first temperature set in Step ST14 may be used as a reference for determination in Step ST15 as the target temperature.

When it is determined that the temperature of the heater 339 is reached the target temperature (Step ST15; Yes), the control portion 150 shifts the operation state of the sheet manufacturing apparatus 100 to the first state and starts the manufacture of the sheet S, that is, a job. (Step ST17).

Here, when the target temperature of the heating roller 86 is set to a temperature obtained by adding the temperature difference ΔT to the first temperature, the control portion 150 performs a treatment of changing the target temperature to the first temperature.

After the manufacture of the sheet S is started, the control portion 150 detects an input of an instruction for suspension by the operation of the suspend instruction button 161*c* (Step ST18). Although the detection of the operation of the suspend instruction button 161*c* can be actually performed as interrupt control, it will be described here as a portion of flow control for the convenience of description.

When the instruction to suspend is input (Step ST18; Yes), the control portion 150 shifts the sheet manufacturing apparatus 100 to the second state (Step ST19).

The treatment performed in Step ST19 is illustrated in detail in FIG. 15.

The control portion 150 changes the target temperature of the heating roller 86 to the second temperature (Step ST51). The second temperature at this time may be the temperature set in Step ST14 or may be a temperature lower than the first temperature in the first state before transition by a preset temperature difference (for example, 10° C.). The control portion 150 operates the roller moving portion 341 to release the nip of the heating portion 84 (Step ST52), and stops the other drive portions (Step ST53). For example, the drive portion stopped in Step ST53 is described as the drive portion turned off in the second state in FIG. 10. Therefore, in the second state, the control portion 150 continues temperature control of the heater 339 and the humidifying heater 345, and sets the temperature of the heating roller 86 to the second temperature which is the target temperature. The treatment order of Steps ST51 to ST53 can be changed as appropriate.

Returning to FIG. 13, after shifting to the second state, the control portion 150 detects an operation of the start instruction button 161*a* (Step ST20), and stands by while the operation of the start instruction button 161*a* is not performed (Step ST20; No). When it is detected that the operation of the start instruction button 161*a* is performed (Step ST20; Yes), the control portion 150 performs a restart sequence (Step ST21).

A treatment performed in Step ST21 is illustrated in detail in FIG. 16.

The control portion 150 changes the target temperature of the heating roller 86, which is a parameter for controlling the heater 339, to the first temperature set in Step ST14 (Step ST61). Here, as described above, the control portion 150 may set the temperature obtained by adding the temperature difference ΔT to the first temperature as the target temperature.

Subsequently, the control portion 150 determines whether or not the temperature of the heating roller 86 is reached the target temperature (Step ST62), and stands by while the target temperature is not reached (Step ST62; No). When the temperature of the heating roller 86 is reached the target temperature (Step ST62; Yes), the control portion 150 activates each drive portion turned off in the second state (Step ST64). The activation of each drive portion may be appropriately started simultaneously with or before or after the treatment of Steps ST61 to ST63.

Returning to FIG. 13, the control portion 150 shifts to the first state, resumes the job (Step ST22), and returns to Step ST18.

When it is determined that the operation of the suspend instruction button 161*c* is not performed (Step ST18; No), the control portion 150 determines whether or not the job is completed (Step ST23). For example, when the number of sheets S to be manufactured is specified in Step ST13 and the manufacture of the specified number of sheets S is completed, the job is completed. Also when the stop instruction button 161*b* is operated, the job is completed.

When the job is not completed (Step ST23; No), the control portion 150 returns to Step ST18. When the job is completed (Step ST23; Yes), the control portion 150 shifts the operation state of the sheet manufacturing apparatus 100 to the second state (Step ST24). The details of the treatment performed in Step ST24 are the same as that in Step ST19.

The control portion 150 starts counting the standby time which is an elapsed time after the sheet manufacturing apparatus 100 is shifted to the second state (Step ST25).

The control portion 150 determines whether or not an input related to a new job is made by the operation of the operation screen 160 (Step ST26). When the input related to the new job is received (Step ST26; Yes), the control portion 150 stops counting the standby time, resets a count value (Step ST27), performs a restart sequence (Step ST28), and returns to Step ST13. The details of the treatment performed in Step ST28 are the same as that in Step ST21.

When there is no input related to the new job after shifting to the second state (Step ST26; No), the control portion 150 refers to the count value of the standby time, and determines whether or not a first set time is passed since the transition to the second state (Step ST29). The first set time is a threshold of the time for changing the target temperature of the heating roller 86 in the second state, and is set in advance, and included in the setting data 121 and stored in the storage portion 140, for example.

When the standby time is reached the first set time (Step ST29; Yes), the control portion 150 changes the target temperature of the heating roller 86 to a third temperature (Step ST30). The third temperature is a temperature lower than the second temperature. For example, when the second temperature is determined in Step ST14, the third temperature may be determined based on the second temperature, or a temperature lower than the second temperature by a preset temperature difference may be used as the third temperature. In addition, the third temperature may be a preset value. The temperature difference or the third temperature is included in the setting data 121 and stored in the storage portion 140, for example.

After the target temperature is changed to the third temperature (Step ST30), and when it is determined that the first set time is not passed (Step ST29; No), the control portion 150 determines whether or not the input related to the new job is made (Step ST31). Here, when the input related to the new job is made (Step ST31; Yes), the control portion 150 proceeds to Step ST27.

When there is no input related to the new job (Step ST31; No), the control portion 150 refers to the count value of the standby time, and determines whether or not a second set time is passed since the transition to the second state. (Step ST32). The second set time is a threshold of a time set in advance, and is included in the setting data 121 and stored in the storage portion 140, for example. When the standby time is reached the second set time (Step ST32; Yes), the control portion 150 performs a stop sequence to shift the sheet manufacturing apparatus 100 to the stopped state (Step ST33). In the stop sequence, for example, as illustrated in FIG. 10, each of the drive portions including the heater 339 and the humidifying heater 345 is stopped. In addition, when the standby time is not reached the second set time (Step ST32; No), the control portion 150 returns to Step ST29.

In the operation of FIG. 13, after the second set time elapses, the control portion 150 may change the target temperature to a temperature lower than the third temperature. That is, in the operation in which the control portion 150 lowers the target temperature stepwise corresponding to the elapse of the standby time, the number of times of changing the target temperature is not limited, and may be three or more. The thresholds of the first set time, the second set time, and the subsequent time are predetermined, and can be separated by a short time.

The stop sequence performed in Step ST33 can be performed as an interrupt treatment when the operation of the stop instruction button 161*b* is performed. In addition, when the operation of the standby instruction button 161*d* is performed, the control portion 150 may perform the operation of Step ST19 as the interrupt treatment.

The sheet manufacturing apparatus 100 can be configured to be able to input a condition related to the manufacture of the sheet S by the operation of the sheet setting portion 163 while the job is being performed. As a matter of course, the sheet setting portion 163 can be operated before starting the job and before starting the next job after completing the job. Furthermore, the operation can be configured to receive the operation of the sheet setting portion 163 regardless of whether the operation is in the first state where the sheet S is manufactured after the start of the job or the second state where the job is temporarily suspended. Specifically, the sheet setting portion 163 can be operated any time after Step ST12 illustrated in FIG. 13. When the condition related to the manufacture of the sheet S is specified by the operation of the sheet setting portion 163 and the start instruction button 161*a* is operated, the control portion 150 performs a treatment of changing the condition as interrupt control.

Figure 17:
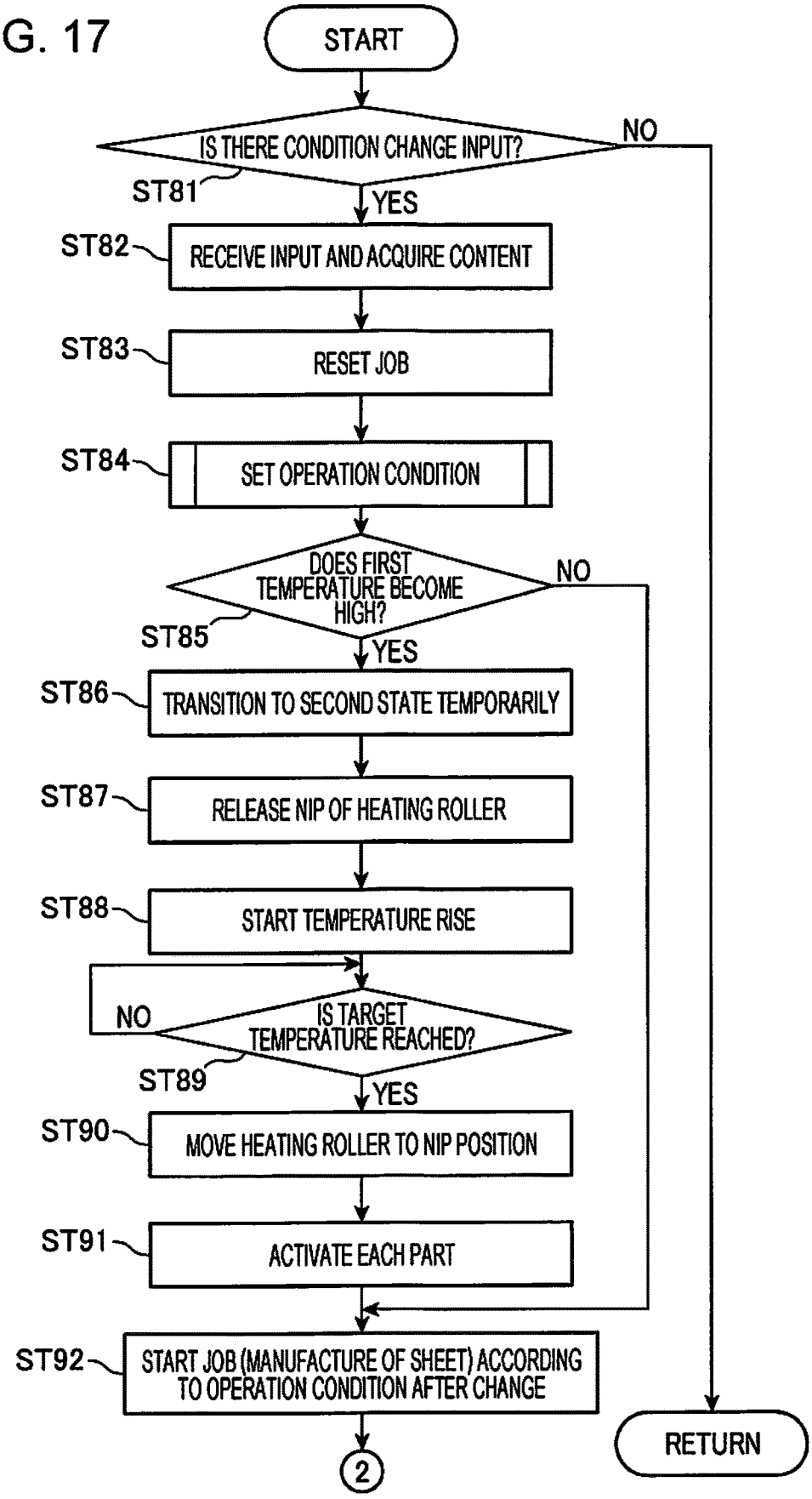
FIG. 17 is a flowchart illustrating an operation of the sheet manufacturing apparatus of the first embodiment.

FIG. 17 is a flowchart illustrating the operation of the sheet manufacturing apparatus 100, and in particular, illustrates the operation performed in the interrupt control when the condition of the sheet S is changed by the operation of the operation screen 160.

When the control portion 150 detects the input of the sheet setting portion 163 and the operation of the start instruction button 161*a* (Step ST81), the control portion 150 receives the input and acquires the content input by the sheet setting portion 163 (Step ST82).

The control portion 150 resets a job that is not completed (Step ST83), and sets operation conditions related to the manufacture of sheet S based on the content acquired in Step ST82 (Step ST84). The details of the treatment performed in Step ST84 are the same as that in Step ST14 (FIG. 13).

The control portion 150 compares the first temperature set for the job reset in Step ST83 with the first temperature set in Step ST84, and determines whether or not the first temperature is high (Step ST85).

When the first temperature is increased (Step ST85; Yes), the control portion 150 temporarily sets the operation state of the sheet manufacturing apparatus 100 to the second state (Step ST86). That is, as illustrated in FIG. 10, among the drive portions of the sheet manufacturing apparatus 100, the drive portions related to the transport of the raw material, the material, and the sheet S are stopped. The heater 339 and the humidifying heater 345 are maintained ON. In addition, since the heater 339 raises the temperature, the heater 339 may remain at the temperature of the first state.

The control portion 150 operates the roller moving portion 341 to release the nip of the heating portion 84 (Step ST87), and starts control to raise the temperature of heating roller 86 to the first temperature which is the target temperature set in Step ST84 (Step ST88). Here, as described above, the control portion 150 may set the target temperature of the heating roller 86 as the temperature obtained by adding the temperature difference ΔT to the first temperature.

The control portion 150 determines whether or not the temperature of the heating roller 86 is reached the target temperature (Step ST89), and waits until the target temperature is reached (Step ST89; No). When the temperature of the heating roller 86 is reached the target temperature (Step ST89; Yes), the control portion 150 moves the heating portion 84 to the nip position (Step ST90), and activates each drive portion turned off in the second state. (Step ST91).

Thereafter, the control portion 150 starts a job according to the changed operation condition (Step ST92), and proceeds to Step ST18 (FIG. 13).

In addition, when the first temperature is the first temperature or lower of the job reset in Step ST83 under the operation conditions set in Step ST84 (Step ST85; No), the control portion 150 proceeds to Step ST92 to starts the job (Step ST92).

Figure 18:
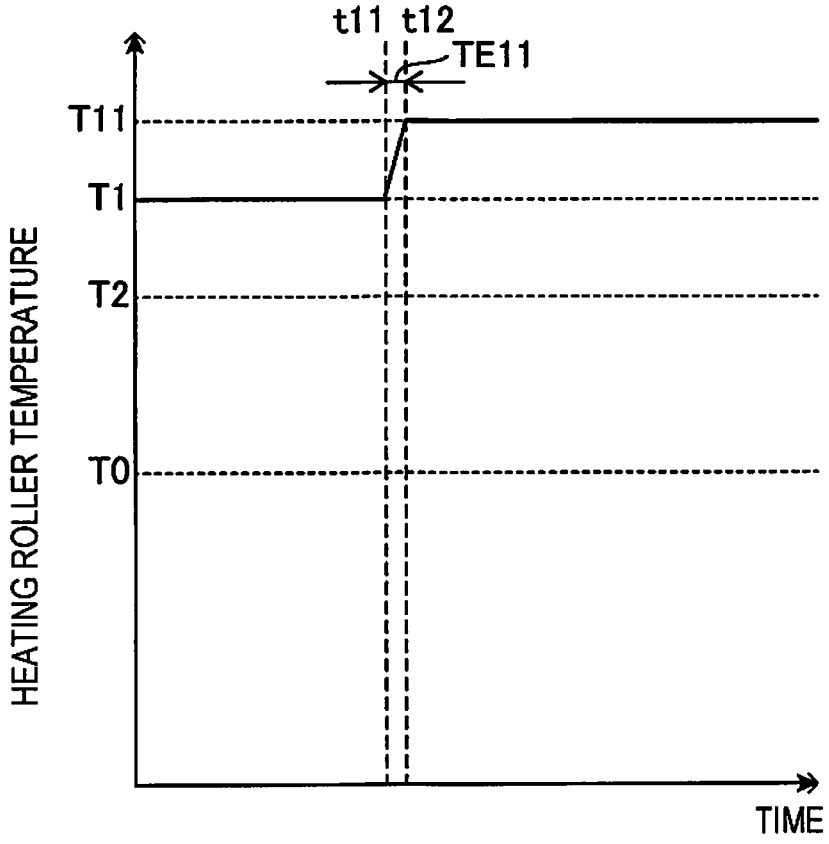
FIG. 18 is a timing chart illustrating an operation example of the sheet manufacturing apparatus of the first embodiment.

FIG. 18 is a timing chart illustrating an operation example of the sheet manufacturing apparatus 100, and in particular, illustrates a change in temperature of the heating roller 86. A vertical axis in FIG. 18 illustrates the temperature of the heating roller 86. For example, this temperature is a temperature detected by the temperature sensor 309. A horizontal axis illustrates the passage of time.

FIG. 18 illustrates the temperature change of the heating roller 86 when the sheet manufacturing apparatus 100 starts the second job after changing the conditions related to the manufacture of the sheet S before the first job is completed after starting the job (first job).

The temperature T1 is the first temperature determined in the first job, and the temperature T11 is the first temperature determined in the second job.

While performing the job based on the first temperature T1, the temperature of the heating roller 86 is maintained at the temperature T1. Here, when the operation condition of the second job is set in Step ST84 and the first temperature T11 of the second job is higher than the first temperature T1 of the first job, the control portion 150 brings the sheet manufacturing apparatus 100 into the second state at time t11.

The control portion 150 starts the temperature rise of the heating roller 86, and starts the job at time t12 when the temperature of the heating roller 86 reaches the temperature T11 which is the target temperature of the second job.

Between time t11 and time t12, the drive portion other than the heater 339 and the humidifying heater 345, more specifically, the drive portion for transporting the raw material, the material, and the sheet S is stopped. Therefore, when manufacturing the sheet S corresponding to the content received in Step ST82, the manufacture of the sheet S is not performed until the temperature of the heating roller 86 changes corresponding to the change of the raw material or the material. As a result, the material which has a heating defect in the heating portion 84 can be reduced. In the sheet manufacturing apparatus 100, it may take time from the start of the manufacture of the sheet S (job start) to the stabilization of the quality of the sheet S. Since the sheet S manufactured during this time may not reach the desired quality, it is recommended to return the sheet S from the discharge portion 96 to the supply portion 10 as the raw material. When heating of the heating roller 86 may be insufficient due to a change in the conditions related to the manufacture of the sheet S, the control portion 150 once stops the drive portion and raises the temperature of the heating roller 86. Therefore, the sheet S insufficiently heated can be reduced, and the amount of the sheet S returned to the raw material can be reduced.

In addition, when the conditions related to the manufacture of sheet S are changed, the type of additive used and the quantity and ratio of each additive may change. In such a case, although the operation condition of the additive supply portion 52 is changed, it takes time for the raw material, to which the additive is added based on the changed operation condition, to be discharged to the discharge portion 96 as the sheet S. Therefore, at the time when the job is started at time t12, the material present between the additive supply portion 52 and the heating portion 84 (includes mixture of subdivided body P and additives, and second web W2, which is referred to as remaining material) is a mixture of additives before the operation conditions are changed. The remaining material is heated at the first temperature T11 corresponding to the changed operation conditions, and thus heated at a temperature different from the temperature suitable for the material. In addition, the color and thickness of the amount of remaining material are adjusted based on the operation conditions before the change. Therefore, the control portion 150 may discharge the sheet S including the amount of remaining material to a position different from the sheet S in the preferable state (non-defective product) in the discharge portion 96 or return the sheet S to the supply portion 10. Alternatively, the notification portion 164 may notify at a timing when all sheets S including the amount of remaining material are discharged to the discharge portion 96 and discharge of the non-defective sheets S is started. For example, when the length of the sheet S discharged from the discharge portion 96 is counted, and the length of the sheet S discharged after time t12 exceeds the distance between the additive supply portion 52 and the discharge portion 96, the control portion 150 may determine that the discharge of the sheet S including the amount of remaining material is completed.

As described above, the sheet manufacturing apparatus 100 according to the first embodiment is an apparatus heating the material containing fibers to form the sheet S, and is provided with the heating portion 84 that heats the material, and the control portion 150 that controls the temperature at which the heating portion 84 heats the material. The control portion 150 sets the temperature of the heating portion 84 to the first temperature in the first state where the sheet manufacturing apparatus 100 manufactures the sheet S. The control portion 150 sets the temperature of the heating portion 84 to the second temperature lower than the first temperature at a predetermined timing in the second state where the sheet S is not manufactured, or at a predetermined timing when shifting to a state where the sheet S is not manufactured.

According to the sheet manufacturing apparatus 100 of the present invention and the sheet manufacturing apparatus 100 to which the control method of the sheet manufacturing apparatus is applied, the temperature of the heating portion 84 can be controlled to the second temperature lower than the first temperature in the state of manufacturing the sheet S. Therefore, for example, when the heating portion 84 is set to the second temperature in the standby state where the sheet S is not manufactured, and the temperature is raised to the first temperature when the manufacture of the sheet S is started, the manufacture of the sheet S can be started more rapidly than when the heating portion 84 is completely stopped. As a result, in the sheet manufacturing apparatus 100, it is possible to reduce the time it takes the apparatus to be able to start the manufacture of the sheet S from the stopped state by a method in which the decrease in energy efficiency is unlikely to occur.

In addition, the sheet manufacturing apparatus 100 is provided with the operation detection portion 153 that receives an input from the outside. The control portion 150 changes the temperature of heating portion 84 from the first temperature to the second temperature in response to the input received by operation detection portion 153. As a result, control can be performed to change the temperature of the heating portion 84 in response to the input from the outside. For example, with the input from the outside as a trigger, the temperature of the heating portion is lowered to be in the standby state, and a decrease in energy efficiency can be suppressed.

In addition, the operation detection portion 153 can receive the input of the type of the sheet S, and the control portion 150 changes the temperature of the heating portion 84 from the first temperature to the second temperature in response to the input of the type of the sheet S received by the operation detection portion 153. As a result, when the type of sheet S is input, control can be performed to change the temperature of the heating portion 84 in response to the input. Therefore, for example, when the temperature condition of the heating portion 84 at the time of manufacturing is different depending on the type of the sheet S, the temperature of the heating portion 84 can be rapidly changed to a temperature suitable for the type of the sheet S.

In addition, the sheet manufacturing apparatus 100 includes the supply portion 10 that supplies waste sheet as a plurality of types of the raw materials, each containing fibers, and the defibrating portion 20 that defibrates the raw material supplied by the supply portion 10. The control portion 150 changes the temperature of the heating portion 84 from the first temperature to the second temperature depending on the type of the raw material supplied by the supply portion 10. As a result, heating is performed by the heating portion 84 at a temperature suitable for the raw material for manufacturing the sheet S, and a high quality sheet S can be manufactured.

In addition, the sheet manufacturing apparatus 100 includes the plurality of stackers 11 that accommodate the plurality of types of the raw materials for each type. The supply portion 10 selects and supplies any one of the plurality of types of the raw materials accommodated in the stacker 11. As a result, it is possible to easily supply different types of the raw materials, and in the step of manufacturing the sheet S from the raw materials, a high quality sheet S can be manufactured by heating at a temperature suitable for the raw materials.

In addition, the sheet manufacturing apparatus 100 includes (the plurality of) the additive cartridges 501 containing the additive as the binding material. The control portion 150 acquires temperature data from the IC 521 disposed in the additive cartridge 501, and determines the first temperature based on the acquired temperature data. According to this configuration, the first temperature of the heating portion 84 can be set to the temperature based on the temperature data acquired from the additive cartridge 501.

Therefore, by acquiring the temperature data related to the heating temperature of the heating portion 84 suitable for the binding material from the additive cartridge 501, the sheet manufacturing apparatus 100 can manufacture the sheet S at the temperature suitable for the binding material without preparing special information in advance.

In addition, the control portion 150 includes (the plurality of) the additive cartridges 501 containing the binding material, and the control portion 150 acquires temperature data from the additive cartridge 501, and determines the second temperature based on the acquired temperature data. According to this configuration, the second temperature of the heating portion 84 can be set to the temperature based on the temperature data acquired from the IC 521. Therefore, by appropriately setting the second temperature based on the temperature data related to the heating temperature of the heating portion 84 suitable for the binding material from the IC 521, when the temperature of the heating portion is raised to the first temperature, the temperature can be rapidly raised, and the standby time can be reduced.

In addition, the sheet manufacturing apparatus 100 is provided with the transport portion that transports the material to the heating portion 84. The transport portion includes the sheet forming portion 80 in a narrow sense. In a broad sense, the transport portion may include the transport portion 79 located more upstream, may include the mesh belt 72, may include the drum portion 61, and may include the mixing blower 56. In addition, the transport portion may include the rotating body 49 located more upstream, may include the mesh belt 46, may include the drum portion 41, and may include the defibrating portion blower 26. In addition, the transport portion may include the defibrating portion 20, may include the coarse crushing portion 12, and may include the supply portion 10. In addition, the drive portion including a motor and a blower for operating these may be used as the transport portion. The sheet manufacturing apparatus 100 performs an operation of transporting the material to the heating portion 84 at least by the transport portion in the state where the sheet S is manufactured, and at least the transport portion stops in the state where the sheet S is not manufactured.

According to this configuration, the heating portion 84 is controlled to the first temperature while the material is transported, and the heating temperature of the heating portion 84 is set to the second temperature in the state where the transport of the material is stopped. As a result, the decrease in energy efficiency while the material is not transported can be suppressed, the temperature of the heating portion 84 can be rapidly raised when the next transport of the material is started, and the standby time can be reduced.

In addition, the vaporization type humidifier 343 having the humidifying heater 345 and humidifying the material is provided, and the humidifying heater 345 of the vaporization type humidifier 343 is operated in a state where the sheet S is not manufactured. According to this configuration, since the humidifying heater 345 of the vaporization type humidifier 343 is not stopped in the state where the sheet S is not manufactured, appropriate humidification can be rapidly started when the manufacture of the sheet S is restarted thereafter. Therefore, the manufacture of the sheet S can be rapidly started. In addition, when the manufacture of the sheet S is restarted, the appropriate humidification state of the material is rapidly realized, so that a high quality sheet S can be manufactured.

In addition, the control portion 150 changes the heating temperature of the heating portion 84 from the first temperature to the second temperature based on the time during which the state where the sheet S is not manufactured continues. According to this configuration, the heating temperature of the heating portion 84 can be reduced corresponding to the operation state of the sheet manufacturing apparatus 100, the state where the manufacture of the sheet S can be rapidly started can be maintained, and the decrease in energy efficiency can be suppressed.

In addition, the control portion 150 stops the control of the heating temperature of the heating portion 84 based on the time during which the state where the sheet S is not manufactured continues. According to this configuration, the energy efficiency can be further improved by stopping the heating of the heating portion 84 corresponding to the operation state of the sheet manufacturing apparatus 100.

In addition, the control portion 150 changes the heating temperature of the heating portion 84 from the second temperature to the third temperature lower than the second temperature based on the time during which the sheet S is not manufactured continues. According to this configuration, the heating temperature of the heating portion 84 can be reduced corresponding to the operation state of the sheet manufacturing apparatus 100, the state where the manufacture of the sheet S can be rapidly started can be maintained, and the energy efficiency can be further improved.

In addition, the sheet S is configured to be manufactured based on a job including at least an instruction to start and end the manufacture of the sheet S or designation of a manufacturing volume. During an operation of manufacturing the sheet S based on the job, the control portion 150 shifts to a suspended state where the sheet S is not manufactured, and sets the heating temperature of the heating portion 84 to the second temperature lower than the first temperature in the suspended state.

According to this configuration, while manufacturing the sheet S based on the job, the heating temperature of the heating portion 84 can be changed to a lower second temperature to be in the suspended state (second state). As a result, for example, it is possible to perform a treatment that is difficult during the operation of manufacturing the sheet S, such as changing the material and changing the type of the sheet S, while the job is performed. In addition, since the heating temperature of the heating portion 84 is controlled to the second temperature in the suspended state, the decrease in energy efficiency can be suppressed. Furthermore, when the manufacture of the sheet S is resumed from the suspended state, the heating portion 84 is controlled to the second temperature, so that the manufacture of the sheet S can be rapidly started.

In addition, the sheet manufacturing apparatus 100 is configured to manufacture the sheet S based on the job including at least an instruction to start and end the manufacture of the sheet S or the designation of the manufacturing volume. The control portion 150 shifts to the standby state where the sheet S is not manufactured after the operation of manufacturing the sheet S based on the job is completed, and the heating temperature of the heating portion 84 is changed from the first temperature to the second temperature based on the time during which the standby state continues. According to this configuration, since the heating temperature of the heating portion 84 is controlled to the second temperature after the manufacture of the sheet S based on the job is completed, the manufacture of the sheet S can be rapidly started when the manufacture of the sheet S is performed again. In addition, the decrease in energy efficiency can be suppressed by setting the heating temperature of the heating portion 84 to second temperature.

In addition, the control portion 150 changes the heating temperature of the heating portion 84 from the second temperature to the first temperature in response to the input from the outside. For example, the input from the outside corresponds to an input operation using the operation screen 160. According to this configuration, the heating temperature of the heating portion 84 can be raised from the second temperature to the first temperature in response to the input from the outside. As a result, for example, separately from the control for starting the manufacture of the sheet S, the heating portion 84 can be heated to prepare for the start of the manufacture of the sheet S, and a state where the manufacture of the sheet S can be rapidly started can be realized at any timing.

In addition, the heating portion 84 includes the pair of heating rollers 86 which interpose and heat the material, and the heating roller 86 is displaceable to a first position which interposes the material and a second position which does not interpose the material. When changing the heating temperature of the heating portion 84 from the first temperature to the second temperature, the control portion 150 displaces the heating rollers 86 pair to the second position. According to this configuration, when the heating temperature of the heating portion 84 is set to the second temperature, the heating roller 86 pair is displaced, so that the heating portion 84 can be in a state suitable to stand by at a temperature lower than the first temperature. As a result, the influence on the material located in the heating portion 84 can be suppressed in the state where the heating portion 84 has the second temperature, and the loss of material can be reduced.

Second Embodiment

Figure 19:
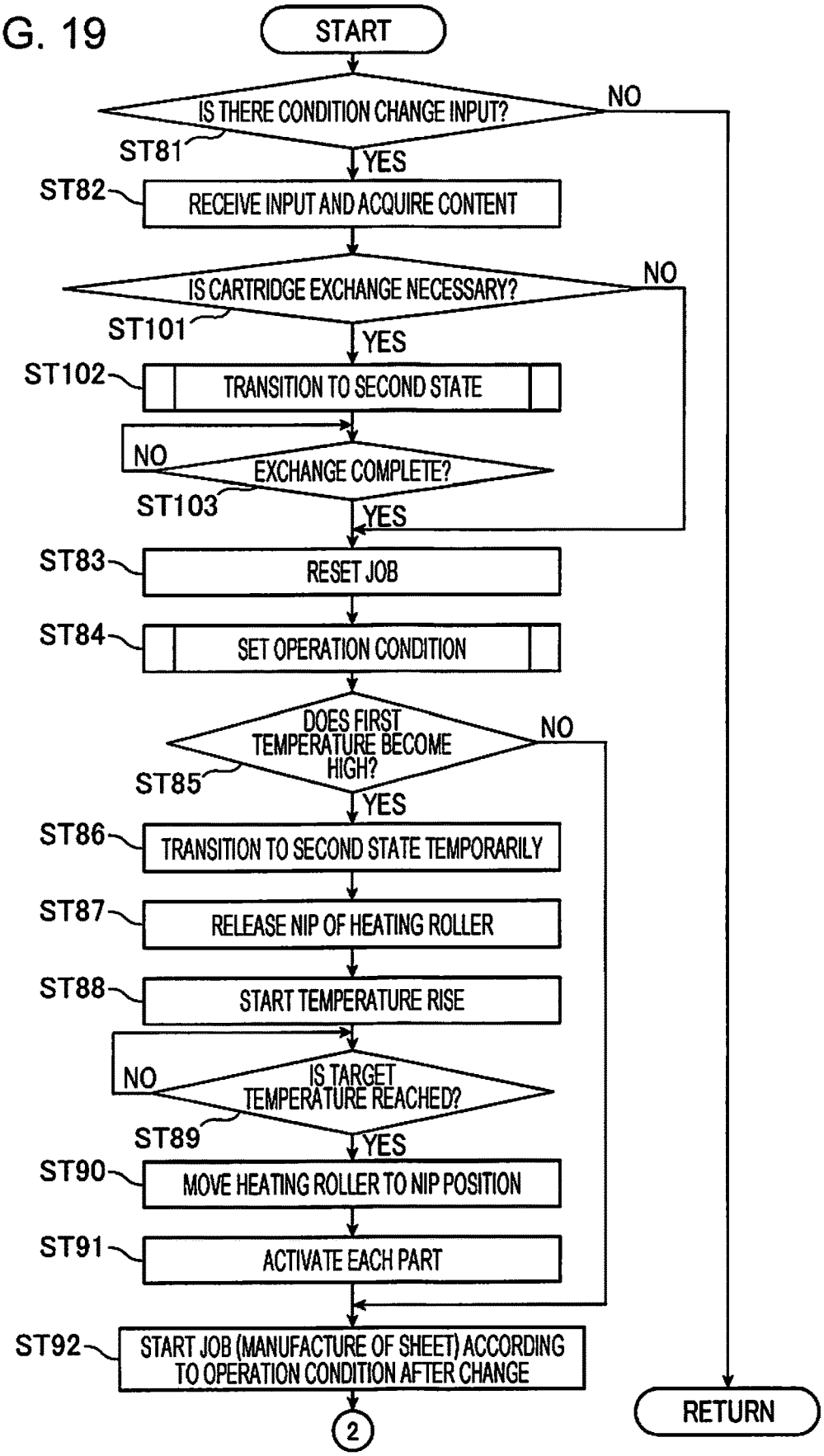
FIG. 19 is a flowchart illustrating an operation of a sheet manufacturing apparatus of a second embodiment.

FIG. 19 is a flowchart illustrating the operation of the sheet manufacturing apparatus 100 according to a second embodiment to which the present invention is applied. The sheet manufacturing apparatus 100 according to the second embodiment has the same configuration as that of the sheet manufacturing apparatus 100 described in the first embodiment, and thus the illustration and the description thereof will not be repeated.

In the second embodiment, the sheet manufacturing apparatus 100 performs the operation of FIG. 19 instead of the operation illustrated in FIG. 17. That is, when the condition of the sheet S is changed by the operation of the operation screen 160, the operation in FIG. 19 is performed in the interrupt control. In the following description, the same step numbers are given to steps common to the operation in FIG. 17.

When the control portion 150 detects the input of the sheet setting portion 163 and the operation of the start instruction button 161*a* (Step ST81), the control portion 150 receives the input and acquires the content input by the sheet setting portion 163 (Step ST82).

Here, the control portion 150 determines whether or not it is necessary to replace the additive cartridge 501 (Step ST101). The control portion 150 determines whether or not the input content acquired in Step ST82 requires an additive different from the additive contained in the additive cartridge 501 already attached to the additive supply portion 52. Various types of additives can be used in the sheet manufacturing apparatus 100, and it is also possible to use a less frequently used color additive so-called special color, for example. In addition, not only the color, but also additives having different influences on the hardness and thickness of the sheet S can also be used. Since the additive cartridge 501 can be attached to and detached from the additive supply portion 52, the additive cartridge 501 containing the less frequently used additive may be attached as needed.

In Step ST101, the control portion 150 determines whether or not it is necessary to replace or add the additive cartridge 501 in order to manufacture the sheet S according to the content acquired in Step ST82. When the control portion 150 determines that the additive cartridge 501 does not need to be replaced or added (Step ST101; No), the control portion 150 proceeds to Step ST83.

On the other hand, when it is determined that the additive cartridge 501 needs to be replaced or added (Step ST101; Yes), the control portion 150 shifts the sheet manufacturing apparatus 100 to the second state (Step ST102). The details of the treatment performed in Step ST102 are the same as that in Step ST19 (FIG. 13). Here, the control portion 150 may perform an operation such as displaying a message on the notification portion 164 (FIG. 9) and perform notification or guidance for prompting replacement of the additive cartridge 501.

The control portion 150 determines whether or not the replacement of the additive cartridge 501 is completed (Step ST103), and stands by while the replacement is not completed (Step ST103; No). When it is determined that the replacement of the additive cartridge 501 is completed (Step ST103; Yes), the control portion 150 proceeds to Step ST83. The operations after Step ST83 are as described in the first embodiment with reference to FIG. 17.

For example, the criterion that the control portion 150 determines that the replacement is completed in Step ST103 includes that the IC 521 of the additive cartridge 501 can be read by the IC reader 119. In addition, the control portion 150 may also determine whether or not the data read from the IC 521 by the IC reader 119 is data of the additive cartridge 501 corresponding to the input content acquired in Step ST82. In this case, when the control portion 150 determines that the additive cartridge 501 corresponds to the input content, the control portion 150 may determine that the replacement is completed. In addition, the control portion 150 may be configured to be able to detect opening and closing of a cover (not illustrated) covering the additive cartridge 501, and it may be determined that the replacement is completed by detecting that the cover is closed. In addition, it is possible to input that the replacement of the additive cartridge 501 is completed on the operation screen 160, and when this input is performed, the control portion 150 may determine that the replacement is completed.

Figure 20:
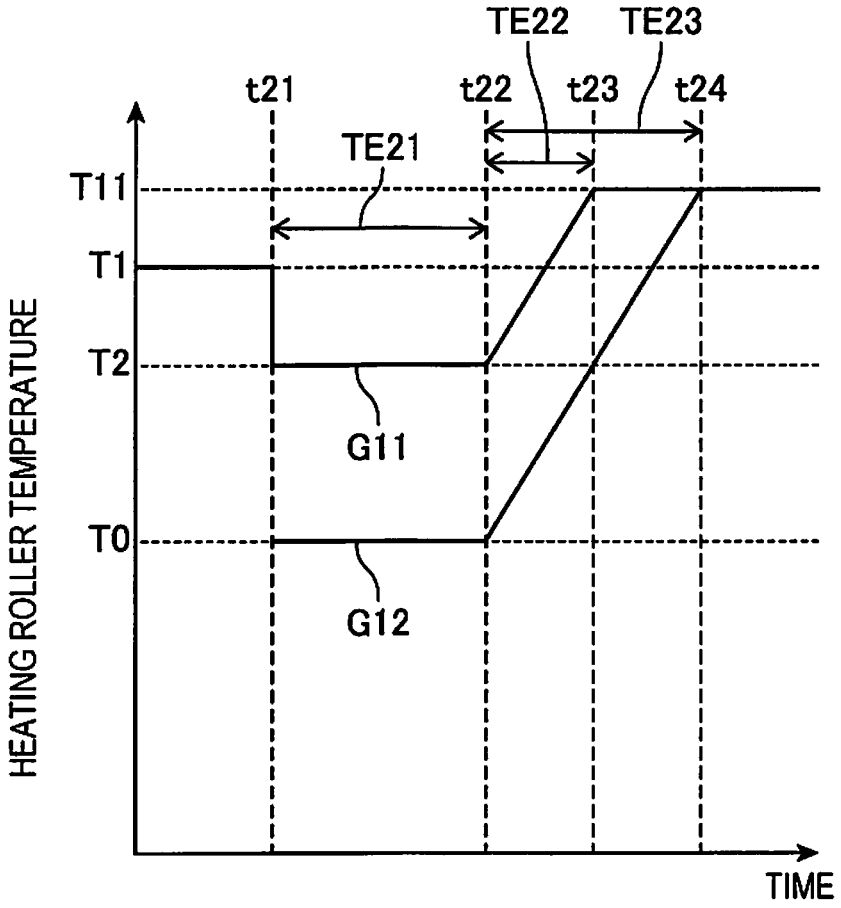
FIG. 20 is a timing chart illustrating an operation example of the sheet manufacturing apparatus of the second embodiment.

FIG. 20 is a timing chart illustrating an operation example of the sheet manufacturing apparatus 100, and in particular, illustrates a change in temperature of the heating roller 86. A vertical axis in FIG. 20 illustrates the temperature of the heating roller 86. For example, this temperature is a temperature detected by the temperature sensor 309. A horizontal axis illustrates the passage of time.

The temperature pattern G11 of FIG. 20 illustrates the temperature change of the heating roller 86 when the second job is started by changing the conditions related to the manufacture of the sheet S before the first job is completed after the sheet manufacturing apparatus 100 starts the job (first job). The temperature T1 is the first temperature determined in the first job, and the temperature T11 is the first temperature determined in the second job. In addition, the temperature pattern G12 indicates the temperature change of the heating roller 86 when the sheet manufacturing apparatus 100 is stopped and the additive cartridge 501 is replaced as a comparative example.

When the control portion 150 determines that the additive cartridge 501 needs to be replaced, the control portion 150 shifts the sheet manufacturing apparatus 100 to the second state at time t22. Thereafter, it is determined that the replacement of the additive cartridge 501 is completed at time t22, and the control portion 150 raises the temperature of the heating roller 86. Thereafter, when the temperature of the heating roller 86 reaches the target temperature at time t23, the control portion 150 starts manufacturing the sheet S.

A period TE21 corresponding to time t21 to time t22 is a time for waiting for the replacement of the additive cartridge 501. A period TE22 between time t22 and time t23 is a waiting time for waiting for temperature rise after the replacement of the additive cartridge 501 is completed.

In the temperature pattern G12 as the comparative example, the heating roller 86 is lowered to the temperature T0 which is at or near the ambient temperature. From this state, the heating roller 86 is heated at time t22. Therefore, it is at time t24 after time t23 that the temperature rise is completed and the manufacture of the sheet S is started. In the temperature pattern G2, after the replacement of the additive cartridge 501 is completed, it is apparent that the waiting time for waiting for the temperature rise is a period TE23, which is longer than the period TE22.

As described above, when it is necessary to replace the additive cartridge 501, the sheet manufacturing apparatus 100 is not shifted to the stopped state, is shifted to the second state, and at least the heater 339 is turned ON, or the heater 339 and the humidifying heater 345 are maintained ON. As a result, the waiting time taken to start the manufacture of the sheet S can be reduced. In addition, in the second state, since the drive portion related to transport of at least the raw material, the material, and the sheet S is stopped, it is possible to prevent an adverse effect due to the attachment and detachment of the additive cartridge 501. The adverse effects include that the raw material or the material is scattered or leaked out of the system from the additive supply portion 52, a state of the subdivided body P, the second web W2 or the sheet S is disturbed by the outside air flowing from the additive supply portion 52, and the like. In addition, there is no possibility that a user who works to replace the additive cartridge 501 feels uneasy due to the movement of the drive portion such as the motor.

The above-described embodiments are merely specific aspects for performing the present invention described in the aspects, and do not limit the present invention. It is not limited that all of the configurations described in the above embodiments are essential constituent requirements of the present invention. In addition, the present invention is not limited to the configuration of the above embodiment, and can be implemented in various aspects without departing from the scope of the invention.

For example, in each of the above-described embodiments, although the configuration is exemplified in which the stacker 11 is provided as the accommodation portion for accommodating the raw material for each type, the present invention is not limited thereto. For example, the raw material defibrated by the defibrating portion 20 may be supplied from the outside. In this configuration, a plurality of cartridges (not illustrated) accommodating the defibrated raw materials may be provided, and it is possible to switch from these cartridges and supply the defibrated material as the raw material to the drum portion 41. In addition, the subdivided body P may be supplied to the tube 54 from the outside as the raw material.

In addition, the sheet manufacturing apparatus 100 of each of the above-described embodiments is described as a dry type sheet manufacturing apparatus 100 that manufactures the sheet S by obtaining a material by defibrating the raw material in the air to use the material and the resin. The application object of the present invention is not limited thereto, and it can also be applied to a so-called wet type sheet manufacturing apparatus in which a raw material containing fibers is dissolved or suspended in a solvent such as water and this raw material is processed into a sheet. In addition, the present invention can also be applied to an electrostatic type sheet manufacturing apparatus in which a material containing fibers defibrated in the air is adsorbed on the surface of a drum by static electricity or the like, and the raw material adsorbed on the drum is processed into a sheet. In these sheet manufacturing apparatuses, the configuration of the above embodiment can be applied in the step of transporting the sheet-like material before being processed into a sheet. When the sheet manufacturing apparatus has the heating portion heating the raw material, the present invention can be applied to the control portion that controls the temperature of the heating portion.

In addition, the sheet manufacturing apparatus 100 may be configured to manufacture a board-like or web-like product configured to include a hard sheet or a laminated sheet, without being limited to the sheet S. In addition, the sheet S may be a sheet made of pulp or waste sheet as the raw material, or may be a non-woven fabric containing fibers made of natural fibers or synthetic resins. In addition, the properties of the sheet S are not particularly limited, and may be a sheet usable as recording sheet (for example, so-called PPC sheet) for writing and printing purposes, or may be a wallpaper, a wrapping paper, a colored paper, a drawing paper, a Kent paper or the like. In addition, when the sheet S is a non-woven fabric, the sheet S may be a fiber board, a tissue paper, a kitchen paper, a cleaner, a filter, a liquid absorber, a sound absorber, a buffer, a mat or the like, in addition to a general non-woven fabric.

REFERENCE SIGNS LIST

9 chute
10 supply portion
11 stacker (accommodation portion)
12 coarse crushing portion
20 defibrating portion
26 defibrating portion blower
27 dust collection portion
28 collection blower
40 sorting portion
41 drum portion
45 first web forming portion
46 mesh belt
48 suction portion
49 rotating body
50 mixing portion
52 additive supply portion
52*a* discharge portion
52*b* supply adjustment portion
52*c* supply tube
54 tube
56 mixing blower
60 accumulating portion
61 drum portion
62 introduction port
70 second web forming portion
72 mesh belt
76 suction mechanism
77 suction blower
79 transport portion
79*a* mesh belt

80 sheet forming portion
82 pressurizing portion
84 heating portion
85 calender roller
86 heating roller
90 cutting portion
92 first cutting portion
94 second cutting portion
96 discharge portion
100 sheet manufacturing apparatus
102 manufacturing portion
110 control device
111 main processor
114 sensor I/F
115 drive portion I/F
116 display panel
117 touch sensor (reception portion)
119 IC reader
120 non-volatile storage portion
121 setting data
122 display data
140 storage portion
150 control portion
151 operating system
153 operation detection portion (reception portion)
154 detection control portion
155 data acquisition portion
156 drive control portion
157 heating control portion
160 operation screen
161 operation instruction portion
161*a* start instruction button
161*b* stop instruction button
161*c* suspend instruction button
161*d* standby instruction button
162 cartridge information display portion
163 sheet setting portion
163*a* color setting portion
163*b* thickness setting portion
163*c* raw material setting portion
164 notification portion
181 first rotating body
182 second rotating body
183 heating body
190 displacement mechanism
202, 204, 206, 208, 210, 212 humidifying portion
301 waste sheet remaining amount sensor
302 additive remaining amount sensor
303 sheet discharge sensor
304 water amount sensor
306 air volume sensor
307 air velocity sensor
309 temperature sensor
311 coarse crushing portion drive motor
313 defibrating portion drive motor
315 sheet feeding motor
317 additive supply motor
318 intermediate blower
325 drum drive motor
327 belt drive motor
329 dividing portion drive motor
331 drum drive motor
333 belt drive motor
335 pressurizing portion drive motor
337 heating portion drive motor
339 heater
341 roller moving portion
343 vaporization type humidifier (humidifying portion)
345 mist type humidifier
345 humidifying heater (heat source)
349 water supply pump
351 cutting portion drive motor
501 additive cartridge (cartridge)
521 IC
H heat source
P subdivided body
S sheet
W1 first web
W2 second web

The invention claimed is:

1. A sheet manufacturing apparatus heating a material containing fibers to form a sheet, the apparatus comprising:
a heating portion that heats the material; and
a control portion that controls a temperature at which the heating portion heats the material, wherein
the control portion sets a temperature of the heating portion to a first temperature in a state where the sheet manufacturing apparatus manufactures the sheet,
the control portion sets the temperature of the heating portion to a second temperature lower than the first temperature
at a predetermined timing in a state where the sheet is not manufactured and the control portion controls the heating portion to be ON, or
at a predetermined timing when a state of the sheet manufacturing apparatus is shifted from the state where the sheet manufacturing apparatus manufactures the sheet to the state where the sheet is not manufactured and the control portion controls the heating portion to be ON, and
the control portion starts counting a standby time in response to the state of the sheet manufacturing apparatus being shifted to the state where the sheet is not manufactured and the control portion controls the heating portion to be ON, and the control portion changes the temperature of the heating portion from the second temperature to a third temperature lower than the second temperature when a time period in which the control portion counts the standby time reaches a predetermined set time period.

2. The sheet manufacturing apparatus according to claim 1, further comprising
a reception portion that receives an input from an outside, wherein
the control portion changes the temperature of the heating portion from the first temperature to the second temperature, or from the second temperature to the first temperature in response to the input received by the reception portion.

3. The sheet manufacturing apparatus according to claim 2, wherein
the reception portion is configured to receive an input of a type of the sheet to be manufactured, and
the control portion changes the temperature of the heating portion from the first temperature to the second temperature, or from the second temperature to the first temperature according to a change in the type of the sheet to be manufactured, by the input in the reception portion.

4. The sheet manufacturing apparatus according to claim 1, further comprising:
a supply portion that supplies a plurality of types of raw materials, each containing fibers; and a defibrating portion that defibrates the raw material supplied by the supply portion, wherein the control portion changes the temperature of the heating portion from the first temperature to the second temperature, or from the second temperature to the first temperature according to a change in a type of the raw material supplied by the supply portion.

5. The sheet manufacturing apparatus according to claim 4, further comprising a plurality of accommodation portions that accommodate the plurality of types of the raw materials for the respective types, wherein the supply portion selects and supplies any one of the plurality of types of the raw materials accommodated in the accommodation portion.

6. The sheet manufacturing apparatus according to claim 1, further comprising a cartridge that contains a binding material, wherein the control portion acquires temperature information from the cartridge, and determines the first temperature based on the acquired temperature information.

7. The sheet manufacturing apparatus according to claim 1, further comprising a cartridge that contains a binding material, wherein the control portion acquires temperature information from the cartridge, and determines the second temperature based on the acquired temperature information.

8. The sheet manufacturing apparatus according to claim 1, further comprising a transport portion that transports the material to the heating portion, wherein at least an operation of transporting the material to the heating portion by the transport portion is performed in the state where the sheet is manufactured, and at least the transport portion is stopped in the state where the sheet is not manufactured and the control portion controls the heating portion to be ON.

9. The sheet manufacturing apparatus according to claim 1, further comprising a humidifying portion that has a heat source and humidifies the material, wherein the heat source of the humidifying portion is operated in the state where the sheet is not manufactured and the control portion controls the heating portion to be ON.

10. The sheet manufacturing apparatus according to claim 1, wherein the control portion changes the temperature of the heating portion from the first temperature to the second temperature based on a time during which the state where the sheet is not manufactured and the control portion controls the heating portion to be ON continues.

11. The sheet manufacturing apparatus according to claim 1, wherein the control portion stops a control of the temperature of the heating portion based on a time during which the state where the sheet is not manufactured and the control portion controls the heating portion to be ON continues.

12. The sheet manufacturing apparatus according to claim 1, wherein the sheet is configured to be manufactured based on a job including at least an instruction to start and end manufacture of the sheet, or designation of a manufacturing volume, and the control portion shifts the state of the sheet manufacturing apparatus to a suspended state where the sheet is not manufactured and the control portion controls the heating portion to be ON during an operation of manufacturing the sheet based on the job, and sets the temperature of the heating portion to the second temperature lower than the first temperature in the suspended state.

13. The sheet manufacturing apparatus according to claim 1, wherein the sheet is configured to be manufactured based on a job including at least an instruction to start and end manufacture of the sheet, or designation of a manufacturing volume, and the control portion shifts the state of the sheet manufacturing apparatus to a standby state where the sheet is not manufactured and the control portion controls the heating portion to be ON after an operation of manufacturing the sheet based on the job is completed, and changes the temperature of the heating portion from the first temperature to the second temperature based on a time during which the standby state continues.

14. The sheet manufacturing apparatus according to claim 1, wherein the control portion changes the temperature of the heating portion from the second temperature to the first temperature in response to the input from an outside.

15. The sheet manufacturing apparatus according to claim 1, wherein the heating portion includes a heating roller pair that interposes and heats the material, the heating roller pair is configured to be displaced between a first position interposing the material and a second position not interposing the material, and the control portion displaces the heating roller pair to the second position, when the control portion changes the temperature of the heating portion from the first temperature to the second temperature.

16. A control method of a sheet manufacturing apparatus heating a material containing fibers to form a sheet, the sheet manufacturing apparatus including a heating portion that heats the material, and a control portion that controls a temperature at which the heating portion heats the material, the method comprising:

controlling the temperature of the heating portion that heats the material at the control portion;

setting, at the control portion, the temperature of the heating portion to a first temperature in a state where the sheet manufacturing apparatus manufactures the sheet;

setting, at the control portion, the temperature of the heating portion to a second temperature lower than the first temperature at a predetermined timing in a state where the sheet is not manufactured and the heating portion is controlled to be ON, or at a predetermined timing when a state of the sheet manufacturing apparatus is shifted from the state where the sheet manufacturing apparatus manufactures the sheet to the state where the sheet is not manufactured and the heating portion is controlled to be ON; and starting, at the control portion, counting a standby time in response to the state of the sheet manufacturing apparatus being shifted to the state where the sheet is not manufactured and the heating portion is controlled to be ON, and changing, at the control portion, the temperature of the heating portion from the second temperature to a third temperature lower than the second temperature when a time period in which the standby time is counted reaches a predetermined set time period.

* * * * *